US007905761B2

(12) United States Patent
Weiss et al.

(10) Patent No.: US 7,905,761 B2
(45) Date of Patent: Mar. 15, 2011

(54) REMOTE CONTROLLED TOY VEHICLE, TOY VEHICLE CONTROL SYSTEM AND GAME USING REMOTE CONTROLLED TOY VEHICLE

(75) Inventors: Stephen Nicholas Weiss, Philadelphia, PA (US); LaVonne Erick Strand, Folcroft, PA (US); Joseph T. Moll, Mount Laurel, NJ (US); Vikas Kumar Sinha, Philadelphia, PA (US); Justin Discoe, Fort Collins, CO (US); David Vincent Helmlinger, Mount Laurel, NJ (US); Gregory Nungester, Titusville, NJ (US); Frank William Winkler, Mickleton, NJ (US); Charles Stewart McCall, San Francisco, CA (US); Jesse Dorogusker, Menlo Park, CA (US)

(73) Assignee: Mattel, Inc., El Segundo, CA (US)

( * ) Notice: Subject to any disclaimer, the term of this patent is extended or adjusted under 35 U.S.C. 154(b) by 442 days.

(21) Appl. No.: 12/217,159

(22) Filed: Jul. 2, 2008
(Under 37 CFR 1.47)

(65) Prior Publication Data

US 2008/0290598 A1 Nov. 27, 2008

Related U.S. Application Data

(60) Division of application No. 11/120,214, filed on May 2, 2005, now Pat. No. 7,758,399, which is a continuation of application No. PCT/US03/34528, filed on Oct. 31, 2003.

(60) Provisional application No. 60/422,728, filed on Oct. 31, 2002.

(51) Int. Cl.
*A63H 30/04* (2006.01)
*A63H 29/22* (2006.01)

(52) U.S. Cl. ..... 446/454; 446/473; 446/484; 463/52

(58) Field of Classification Search ..... 446/43, 446/441, 454–456, 465, 6, 473, 484.1; 463/1, 463/51–53; 273/454, 455
See application file for complete search history.

(56) References Cited

U.S. PATENT DOCUMENTS

| | | | |
|---|---|---|---|
| 4,245,430 | A | 1/1981 | Hoyt |
| 4,334,221 | A | 6/1982 | Rosenhagen et al. |
| 4,844,474 | A | 7/1989 | Schaub et al. |
| 4,874,936 | A | 10/1989 | Chandler et al. |
| 4,894,042 | A | 1/1990 | Kamikawa |
| 4,938,483 | A | 7/1990 | Yavetz |
| 4,964,837 | A | 10/1990 | Collier |

(Continued)

FOREIGN PATENT DOCUMENTS

| | | |
|---|---|---|
| GB | 2 326 003 | 9/1998 |

(Continued)

*Primary Examiner* — Kien T Nguyen
(74) *Attorney, Agent, or Firm* — Panitch Schwarze Belisario & Nadel LLP

(57) ABSTRACT

A vehicle toy combination includes a wireless controlled toy vehicle having a mobile platform configured to move over a surface. A central controller on the platform is configured to control at least one aspect of the toy vehicle. A hand-held manually actuable wireless controller is configured to remotely control user selected movement of the toy vehicle. Multiple vehicles can be controlled simultaneously with multiple wireless, manually operated controllers operating at the same frequency by initially synchronizing the controllers to transmit in non-overlapping windows.

30 Claims, 25 Drawing Sheets

U.S. PATENT DOCUMENTS 5,100,153 A 3/1992 Welte
5,127,658 A 7/1992 Openiano
5,195,920 A 3/1993 Collier
5,259,808 A 11/1993 Garr
5,267,754 A 12/1993 Kaule
5,637,996 A 6/1997 McDarren et al.
5,702,107 A 12/1997 Novak
5,713,586 A 2/1998 Haller
5,816,886 A 10/1998 Cusolito
5,896,017 A 4/1999 Severson et al.
5,906,542 A * 5/1999 Neumann ..... 463/52
5,994,853 A 11/1999 Ribbe
6,068,537 A 5/2000 Lupton
6,071,166 A 6/2000 Lebensfeld et al.
6,171,172 B1 1/2001 Foster et al.
6,224,454 B1 5/2001 Cheng et al.
6,248,019 B1 6/2001 Mudie et al.
6,254,486 B1 7/2001 Mathieu et al.
6,308,114 B1 10/2001 Kim
6,482,064 B1 11/2002 Lund
6,491,566 B2 * 12/2002 Peters et al. ..... 446/454
6,695,668 B2 2/2004 Donahue et al.
6,780,077 B2 8/2004 Baumgartner et al.
6,824,059 B2 11/2004 Jam et al.
2001/0005001 A1 6/2001 Ireland
2002/0106967 A1 8/2002 Weiss et al.

FOREIGN PATENT DOCUMENTS

WO 99/03550 A 1/1999

* cited by examiner

| | Bit: | 6 | 5 | 4 | 3 | 2 | 1 | 0 | |
|---|---|---|---|---|---|---|---|---|---|
| 132 | Drive Flag: | | 0 | 1 | 1 | 1 | 1 | 0 | 132 |
| | Drive Data: | ID1 | ID0 | Turbo | FwL | RevL | FwR | RevL | 134 |
| 136 | Fire Flag: | | 0 | 1 | 1 | 1 | 1 | 1 | 137 |
| | Fire Data: | ID1 | ID0 | EM1 | HG | Ping | FrFw | FrRev | 138 |
FIG. 13A
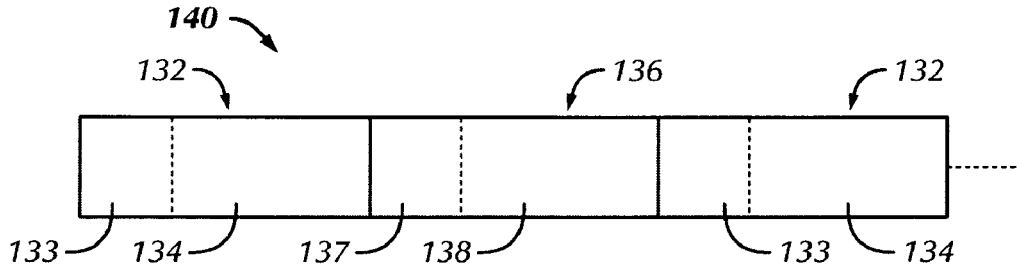
FIG. 13B
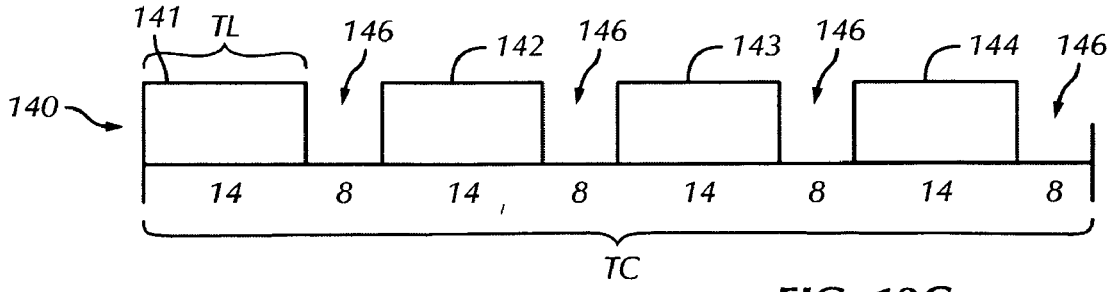
FIG. 13C

REMOTE CONTROLLED TOY VEHICLE, TOY VEHICLE CONTROL SYSTEM AND GAME USING REMOTE CONTROLLED TOY VEHICLE

CROSS-REFERENCE TO RELATED APPLICATIONS

This application is a division of pending U.S. patent application Ser. No. 11/120,214 filed 2 May 2005, which claims priority to U.S. Provisional Application No. 60/422,728 filed 31 Oct. 2002 and International Application No. PCT/US03/34528 filed 31 Oct. 2003, the disclosures of which are all incorporated by reference herein in their entirety.

BACKGROUND OF THE INVENTION

The present invention relates generally to a remotely controlled battery powered toy vehicle which includes one or more vehicle mounted simulated weapons which may be employed for playing a single player or multi-user game.

Remotely controlled battery powered toy vehicles are generally well known. Such toy vehicles may take the form of a race car, truck, motorcycle, sport utility vehicle or the like or may include a fighting vehicle, such as a jeep, tank, hummer, etc. Additionally, incorporating simulated weapons into such remotely controlled toy vehicles, particularly such as a fighting vehicle is also generally well known. The present invention includes an improvement upon such known remotely controlled toy vehicles with such remotely fireable simulated weapons by incorporating from one to four such toy vehicles into an interactive game, where each of the vehicles may be separately controlled by different users for playing the game.

BRIEF SUMMARY OF THE INVENTION

One aspect of the present invention is, in a wireless controlled toy vehicle system having a plurality of at least two independently remotely controllable toy vehicles, each of the toy vehicles being independently remotely controlled by a separate, respective, associated hand-held manual wireless controller of a plurality of hand-held manual wireless controllers of the system, each of the plurality of toy vehicles having actuators for controlling the operation of the plurality of vehicles in accordance with control signals received from the associated, respective manual wireless controller of the plurality of manual wireless controllers, an improvement comprising: a first manually actuable wireless controller of the plurality being respectively associated with a first of the plurality of toy vehicles and generating a stream of first control signal packets in response to user manual inputs to the first controller, the stream of first control signal packets being transmitted to the plurality of toy vehicles during a first transmission window and coded to control only the first of the plurality of toy vehicles; and a second manually actuable wireless controller being respectively associated with a second of the plurality of toy vehicles and generating a stream of second control signal packets in response to user manual inputs to the second controller, the stream of second control signal packets being transmitted to the plurality of toy vehicles during a second transmission window and coded to control only the second of the plurality of toy vehicles, wherein the first and second transmission windows are time synchronized such that the streams of first and second control signal packets avoid time overlap of each other when transmitted to the plurality of toy vehicles while user inputs are being simultaneously manually entered into at least the first and second manually actuable wireless controllers.

Another aspect of the present invention is a method for controlling a plurality of at least two toy vehicles in a wireless controlled toy vehicle system (50), each of the toy vehicles of the plurality being remotely controlled by separate respective associated manually actuable wireless controllers, the at least two toy vehicles having actuators for controlling the operation of the at least two toy vehicles in accordance with control signals received from the respective associated manually actuable hand-held, wireless controllers, the method comprising: defining a series of sequential, repeated first and second transmission windows, each transmission window having a single, common transmission window length (TL); time synchronizing the first and second transmission windows such that the first and second windows do not overlap each other; generating a stream of first control signal packets; generating a stream of second control signal packets; of transmitting the stream of first control signal packets to the plurality of toy vehicles during the first transmission window to control only a first of the plurality of toy vehicles; and transmitting the stream of second control signal packets to the plurality of toy vehicles during the second transmission window to control only a second of the plurality of toy vehicles.

Another aspect of the present invention is an interactive toy vehicle game system comprising: at least one wireless controlled toy vehicle having a mobile platform configured to move over a playing surface, an on-board vehicle controller configured to control the at least one toy vehicle based on manual input from a player, at least one vehicle weapon mounted to the mobile platform and configured to fire on an enemy vehicle and at least one damage sensor mounted to the at least one toy vehicle and configured to detect hits on the at least one toy vehicle; and at least one mobile droid vehicle having a mobile droid platform configured to move over the playing surface, the at least one mobile droid vehicle having an enemy weapon mounted to the mobile droid platform and an on-board mobile droid controller configured to seek the at least one toy vehicle and fire the enemy weapon at the at least one toy vehicle; wherein the vehicle controller is further configured to disable the at least one toy vehicle when the vehicle controller detects collectively from each damage sensor of the vehicle a predetermined number of hits from the enemy weapon.

BRIEF DESCRIPTION OF THE SEVERAL VIEWS OF THE DRAWINGS

The following detailed description of preferred embodiments of the invention will be better understood when read in conjunction with the appended diagrammatic drawings. For the purpose of illustrating the invention, there is shown in the drawings embodiments which are presently preferred. It should be understood, however, that the invention is not limited to the precise arrangements and instrumentalities shown.

In the drawings:

FIG. 13*a* is a table showing drive and fire data packets generated by a radio controller;

FIG. 13*b* is a diagram illustrating a stream of control signal packets;

FIG. 13*c* is a diagram illustrating the transmission windows and dead space between transmission windows of the time division multiplex communication scheme;

DETAILED DESCRIPTION OF THE INVENTION

Figure 1:
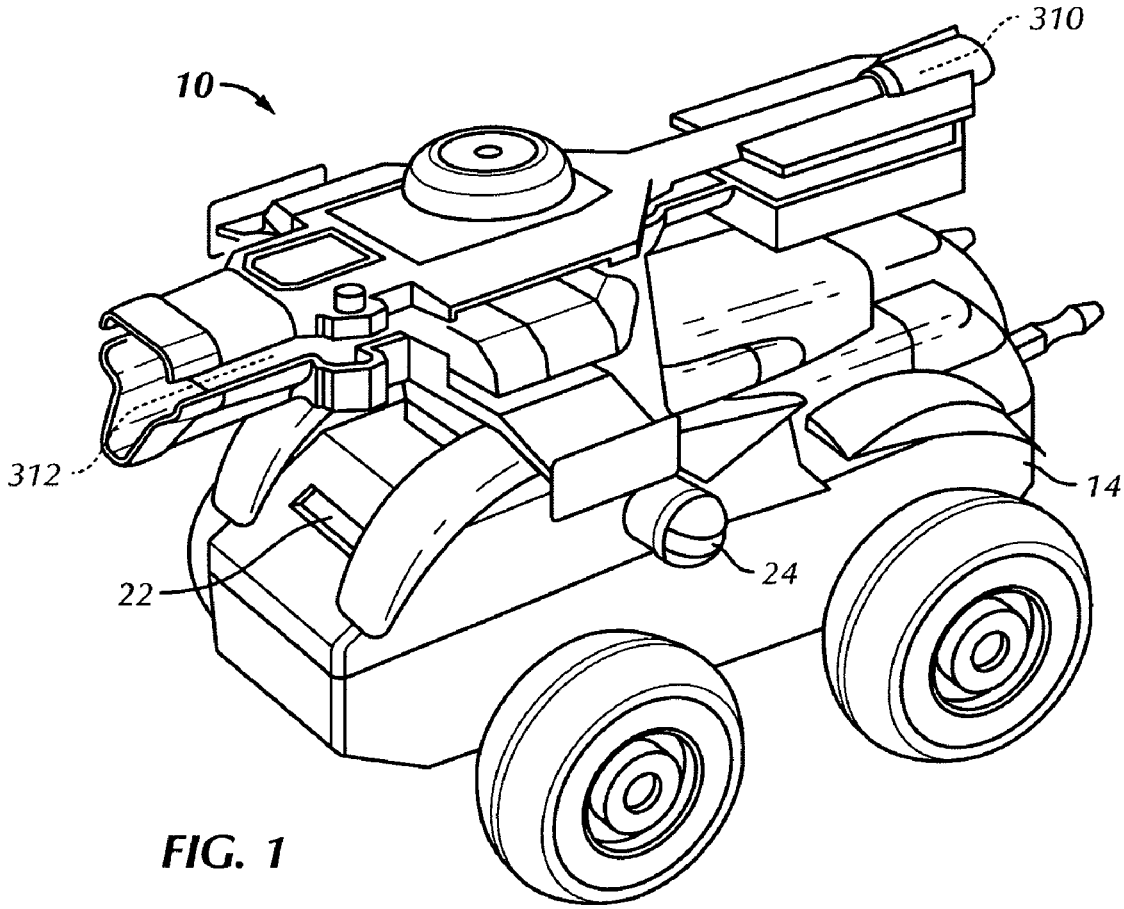
FIG. 1 is a perspective view of a preferred exemplary embodiment of a toy vehicle in accordance with the present invention with a cover plate slightly raised.

The present invention, in one embodiment, comprises a remotely controlled toy vehicle 10. In the presently preferred embodiment, the remotely controlled toy vehicle 10 is in the form of a fighting vehicle such as a tank or other such armored vehicle, Humvee or the like, which moves over a surface 16. The present invention is not limited to a remotely controlled toy vehicle having a particular shape, size, configuration or appearance. The remotely controlled toy vehicle 10 includes a mobile platform 14, one or more battery powered electric motors 302, 304 (FIG. 3) and associated gears, transmissions or other drive mechanisms and control circuitry (FIG. 3) to permit the movement of the toy vehicle 10 in the forward or rearward direction and to permit the toy vehicle 10 to turn to the left or the right under the remote control of a user. Power for the toy vehicle is provided by one or more on-board batteries 306 which may comprise a rechargeable battery pack, individual rechargeable batteries, non-rechargeable batteries or the like.

Figure 2A:
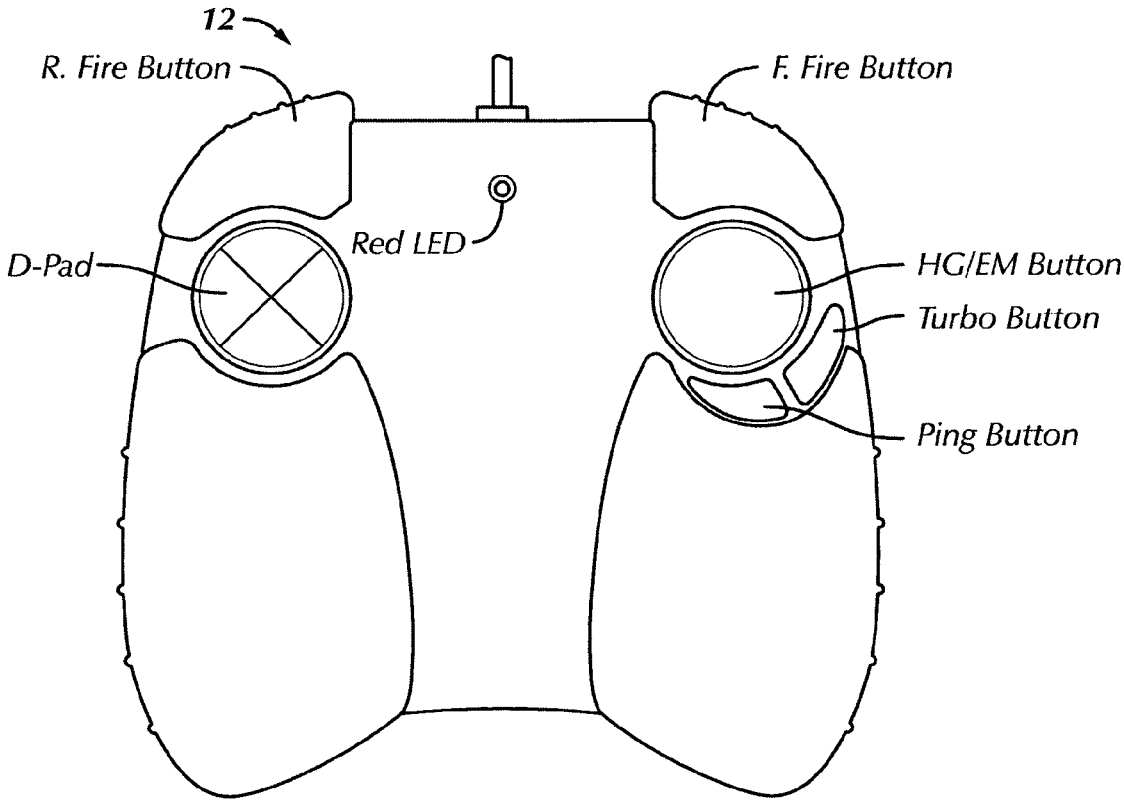
FIGS. 2*a*, 2*b* and 2*c* are front, side and rear elevational views of a preferred embodiment of a radio controller in accordance with the present invention.
Figure 2B:
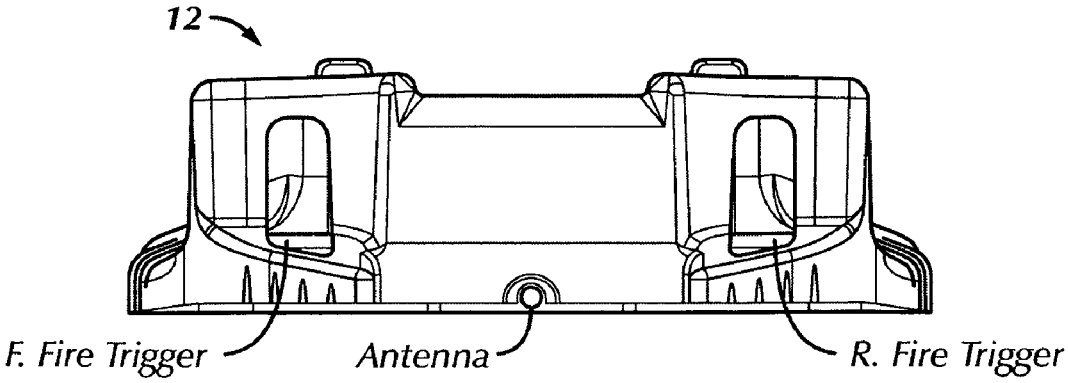
Figure 2C:
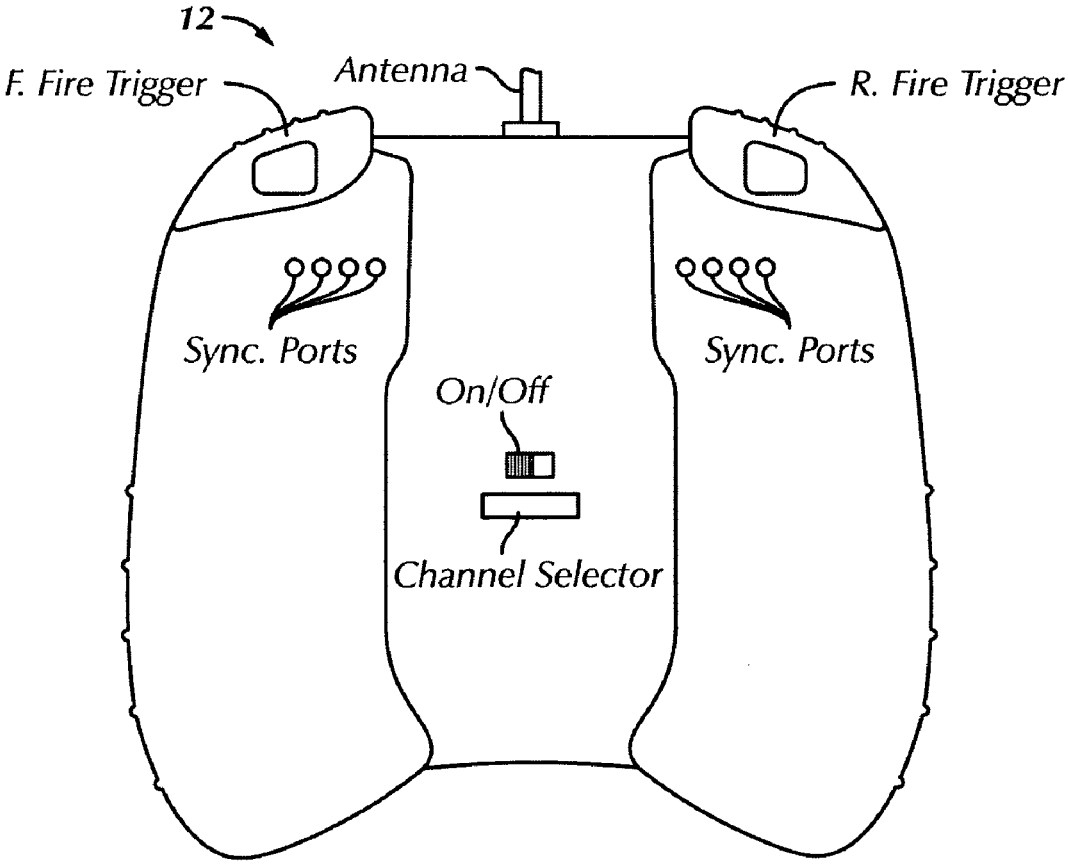

The toy vehicle 10 further includes an on-board control system, or central vehicle hand-held, controller 300 (FIG. 3) which is employed for controlling at least one aspect of the toy vehicle 10, such as movement of the vehicle, based at least in part upon control signals received from a wireless, preferably, radio remote controller 12 (FIGS. 2*a*-2*c*). The remote controller 12 is preferably manually operated by a user and configured to remotely control user selected movement of the toy vehicle 10. Thus, the toy vehicle 10 does not adhere to any defined movement such as, for example, movement along a track. In the presently described embodiment, control signals are transmitted from the radio controller 12 to the central controller 300 of the toy vehicle 10 using radio technology and a control scheme which will hereinafter be described in greater detail. However, any other suitable form of transmission technology, particularly optical such as infrared, could alternatively be employed for controlling the operation of the toy vehicle and a different control scheme could also be used. "Wireless" refers to the communication channel(s) between the hand-held user operated, remote controller and the toy vehicle being controlled. Additionally, the toy vehicle 10 and radio controller 12 may be utilized in a game system having multiple toy vehicles 10, each having their own, separate associated radio controller 12 for remote radio control of the corresponding toy vehicle.

Control Scheme

Figure 11:
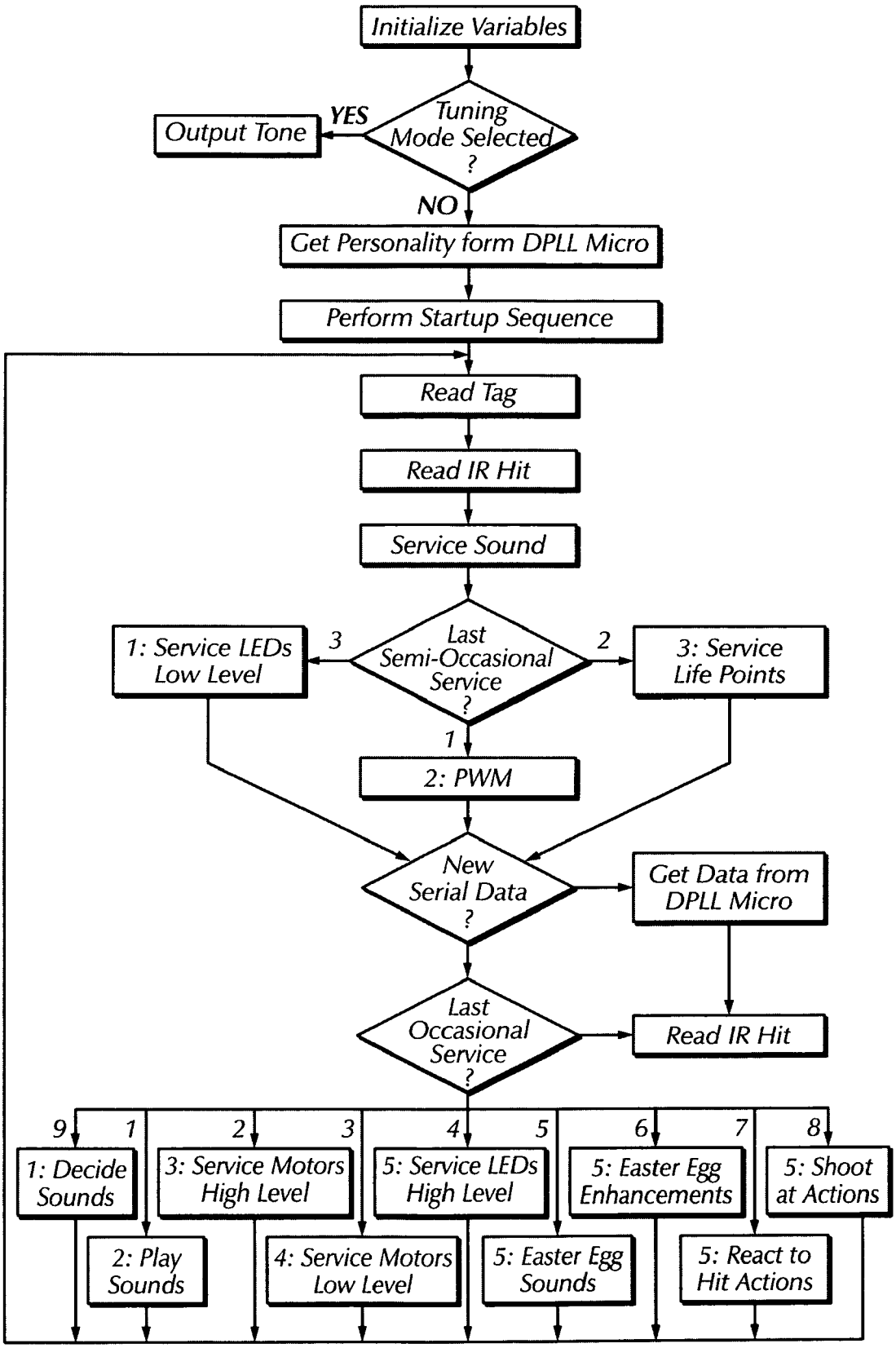
FIG. 11 is a flow diagram illustrating the operation of the service function MCU of FIG. 3.

In the presently preferred embodiment, firmware control of the toy vehicle 10 of FIG. 1 operates entirely in the foreground; that is on a non-interrupt basis with a series of scheduled service routines at predetermined, scheduled times. In the preferred embodiment, the on-board toy vehicle control system 300 includes a service function microprocessor MCU 316 model SPC 215B which runs at a speed of six MHz. The MCU 316 may be any microprocessor known in the art capable of performing the tasks associated with the control system 300. Running the MCU 316 at 6 MHz allows the firmware to perform all of the required service routines on a non-interrupt basis at regularly scheduled times. The required on-board firmware functions which must be performed can be divided into three categories; functions that must happen at 8 kHz, functions that must happen at about 1 kHz, and functions that may happen less frequently (i.e., less than 100 Hz) and with less precision of scheduling (i.e., plus or minus tens of milliseconds). The basic loop "service" time for the MCU 316 is preferably 125 microseconds (8 kHz) to allow all of the required functions to be serviced at the required time intervals without overlapping. For example, the sound function is serviced at 8 kHz (four times per service loop) while the infrared hit detection, infrared gun and optical tag read functions are all serviced at 8 kHz (20 percent of the time the gun function happens at 8 kHz, 80 percent of the time it is not serviced), the various functions are alternated so they are all serviced at a minimum of the frequency as shown in the diagram of FIG. 11.

Running the MCU 316 at 6 MHz allows the firmware to perform all of the required service routines with each service routine being performed no more frequently than is necessary. Sufficient additional time is available for making changes in the routines without changing the speed of the microprocessor.

Figure 3:
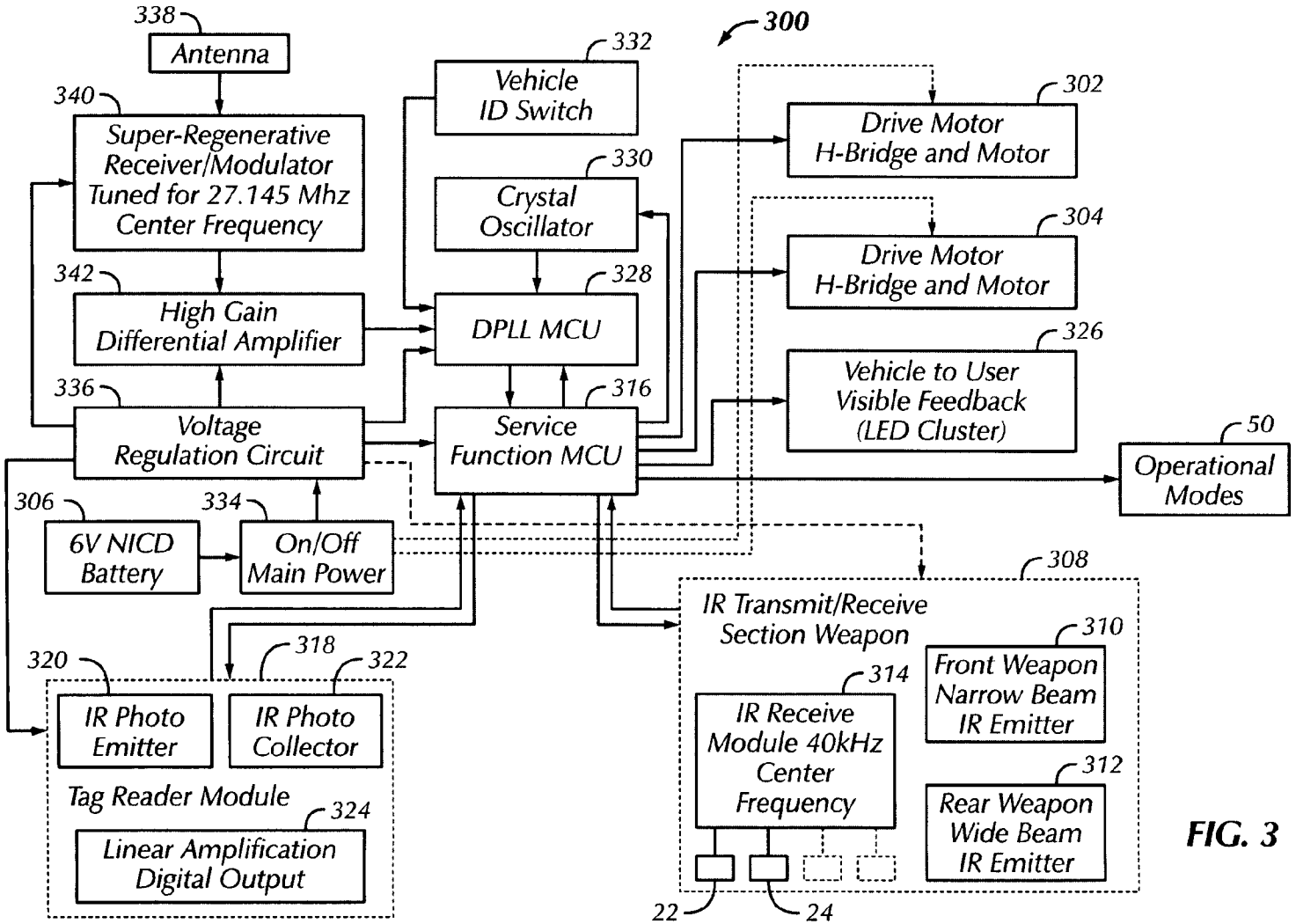
FIG. 3 is a functional block diagram schematic of the on-board vehicle control system of the toy vehicle of FIG. 1.

The central controller 300 further includes a separate microprocessor, preferably a DPLL MCU 328, for receiving and decoding control signals received from the radio controller 12 in a manner which will hereinafter become apparent. An oscillator 330 which may be a crystal oscillator, RC oscillator, external oscillator or the like, is included for establishing the timing of the service function MCU 316 and the DPLL MCU 328 in a manner well known to those of ordinary skill in the art. Each central controller 300 further includes a vehicle identification switch 332, which may be set to any one of several different positions to discriminate between different toy vehicles 10 used in playing a game. As shown in FIG. 3, the central controller 300 includes an on/off power switch 334 and a voltage regulation circuit 336 for providing regulated voltage to the various other systems and subsystems of the central controller 300.

Figure 12:
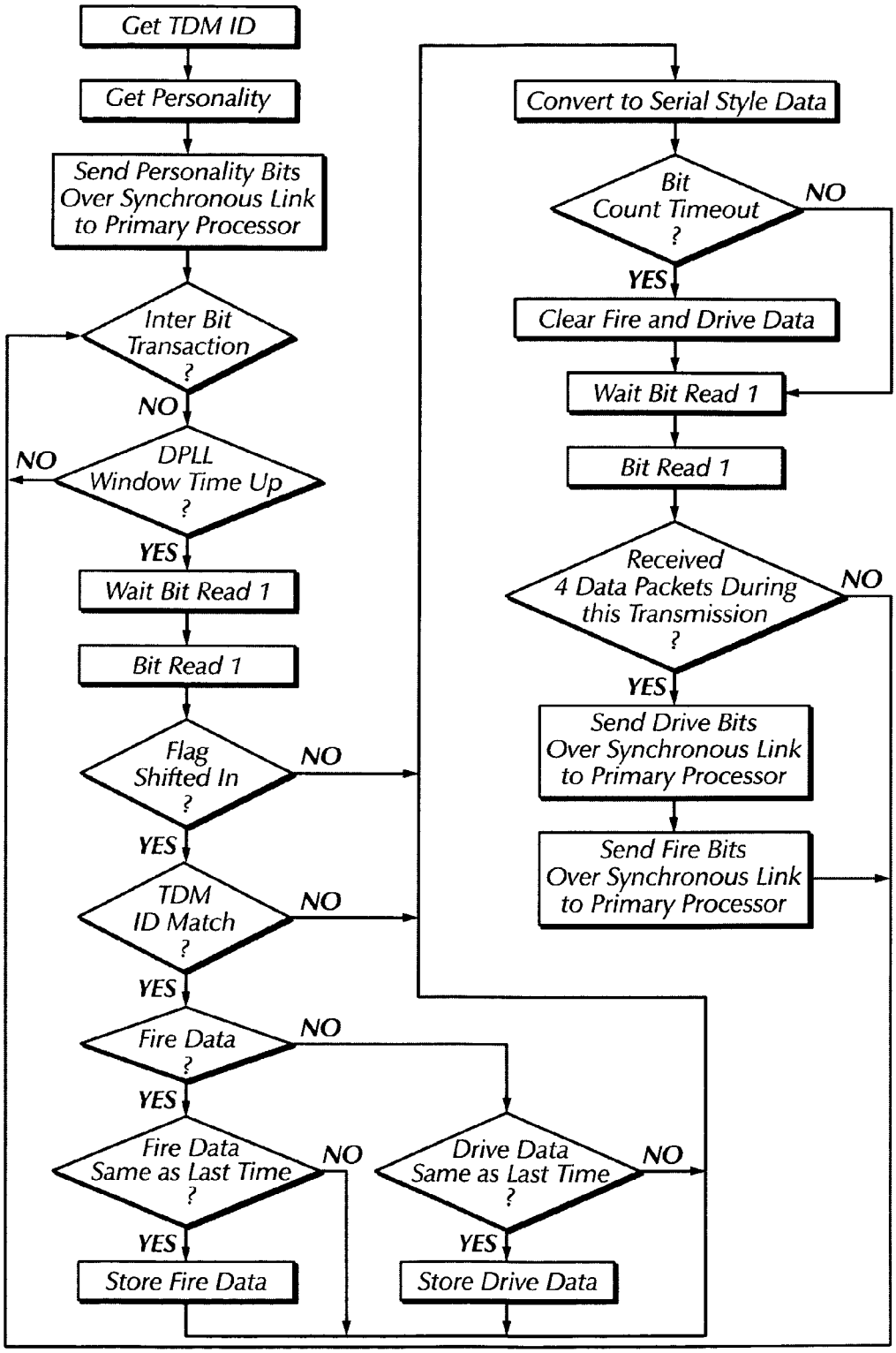
FIG. 12 is a flow diagram illustrating the receiver functioning of the DPLL MCU of FIG. 3.

The exemplary toy vehicle 10 includes a suitable antenna 338 for receiving radio frequency signals from the remote radio controller 12. The antenna may be hidden under or within the body of vehicle 10. Output signals from the antenna 338 are sent to a receiver/demodulator 340 for demodulation of the received radio frequency signals. Output signals from the receiver/demodulator 340 are fed to the DPLL MCU 328 through a high gain differential amplifier 342. The DPLL MCU 328 receives and decodes the instruction signals in a manner as illustrated by the flow diagram of FIG. 12 and as is well known to those of ordinary skill in the art. Further details concerning the structure and operation of the various components and subassemblies of the on-board central controller 300 are well known to those of ordinary skill in the art and available from a variety of sources.

Communication Scheme

Figure 4:
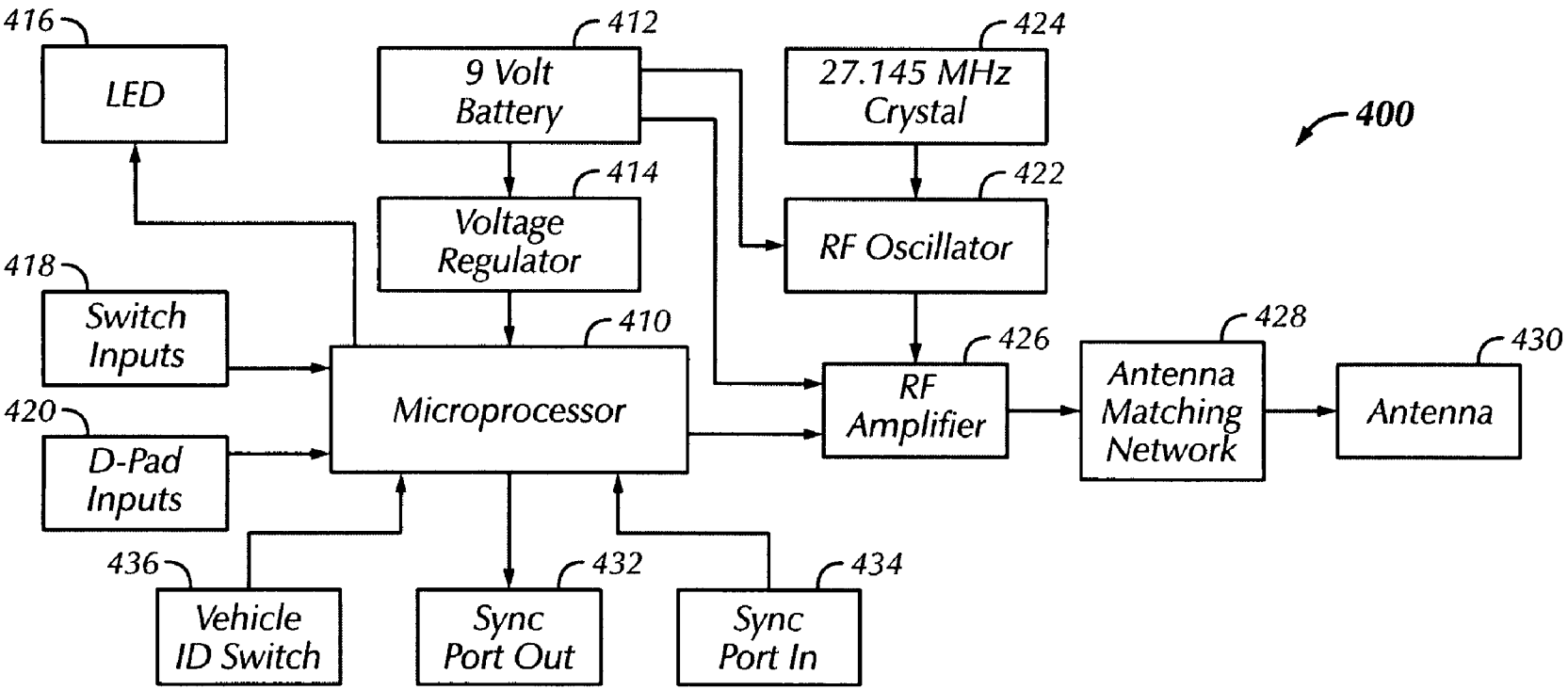
FIG. 4 is a functional block diagram schematic of the circuitry of the radio controller of FIG. 2.

FIG. 4 is a schematic block diagram of a preferred embodiment of the circuitry 400 employed within the remote radio controller 12. The circuitry 400 of the radio controller is generally typical of remote control units known to those of ordinary skill in the art for controlling the operation of a remotely controlled toy vehicle. Accordingly, while FIG. 4 illustrates a presently preferred embodiment of the remote control circuitry 400, it should be understood by those of ordinary skill in the art that the communication system or scheme could be implemented in some other manner, if desired. The remote control unit circuitry 400 includes an encoder portion having a microprocessor 410 employed for generating a stream of control signal packets for controlling the operation of the toy vehicle 10. The microprocessor 410 is preferably of a type already used and well known to those of ordinary skill in this art. The remote control circuitry 400 is powered by a battery, preferably a 9-volt battery 412 which may be of the rechargeable or non-rechargeable type. Power from the battery 412 is applied to the microprocessor 410 through a suitable voltage regulator 414 also of a type well known to those of ordinary skill in the art. The battery 412 also provides power to the other components and subassemblies of the control circuit shown in FIG. 4. A light emitting diode (LED) 416 is employed for providing to a user an indication of the remaining battery power.

In the present embodiment, bi-phase encoded bits are used with each bi-phase encoded bit being of the same predetermined width and employing a fifty percent duty cycle including two transmit elements per encoded bit. Another form of encoding and/or a different duty cycle could be employed, if desired. In the present embodiment, one binary state, binary "0", is defined as both of the transmit elements of a bit being the same and the other binary state, binary "1", is defined as both of the transmit elements of a bit being opposite. The use of such a bi-phase encoding scheme is beneficial in that it permits reading of the state of a bit by reading the center portion of each transmit element. The state (high or low) always changes between bits.

Referring to FIG. 13*a*, in the present embodiment there are two types of data packets, a "drive" data packet and a separate "fire" data packet. Each drive data packet 132 preferably includes a single, unchanging, six bit drive flag 133, in the present embodiment 011110, followed by seven bits of drive data 134 (e.g. ID1, ID0, turbo, forward left, reverse left, forward right and reverse left) depending on the user selection of the direction and speed of movement of the toy vehicle 10. Similarly, in the present embodiment, each fire data packet 136 preferably includes a single, unchanging six bit fire flag 137 (011111), followed by seven bits of fire data 138 (e.g. ID1, ID0, EM, HG, ping, forward fire and rearward fire) depending on the user selected fire options. The radio controllers 12 transmit the control data packets 132 or 136 in a steam 140 of packets (see FIG. 13*b*). Since no check sum bits are used, the presently preferred embodiment relies upon the receipt of two or more identical data packets 132 or 136 as verification of the validity of the received drive and/or fire data.

In addition, with the presently preferred embodiments, if the user has not selected vehicle movement or the firing of a weapon, no corresponding data packets are transmitted. For example, if the user is moving the toy vehicle 10 without firing a weapon, only the drive data packet 132 will be continuously transmitted whereas if the toy vehicle 10 is not moving, only the selected fire data packet 136 will be continuously transmitted. If the toy vehicle 10 is firing a weapon while moving both the drive data packet 132 and the fire data packet 136 will be transmitted in an alternating pattern, as shown in FIG. 13*b*.

In addition to the microprocessor encoder 410, the circuitry 400 of the manually actuable controller(s) 12 includes a plurality of control switches or user manual inputs 418, 420, which are manually activated by a user for controlling the operation of the toy vehicle 12. In the present embodiment a "D-pad" 420 is used for controlling the movement of the toy vehicle 10 (forward, backward, left, right) and additional control switches/buttons 418 are employed for controlling the firing of the simulated weapons on the toy vehicle 10. The user controlled switches 418, 420 may alternately be in the form of lever switches, push button switches, a joy stick or the like. The position of each of the D-pad 420 and fire control switches 418 generates signals which are employed as inputs to the microprocessor encoder 410 which in turn uses the inputs to "encode" the signals by generating the signal packets. As long as the D-pad 420 and fire control switches 418 remain in the same positions, the microprocessor 410 continuously generates the same control signal packet as a stream of packets 140. If the position of any of the control switches changes, the microprocessor 410 senses the change and generates a series of new control signal packets. If neither the D-pad 420 nor any of the fire control switches 418 are active, no control signals are transmitted.

Each remote radio controller 12 includes a vehicle identification switch 436 having an output which is encoded and transmitted within each control signal packet 132, 136 and which when received is decoded and compared to the position of the output of the vehicle identification switch 332 in the central controller 300 for identity comparison purposes. The codes from the vehicle identification switch 436 are transmitted in each control data packet 134, 138, such that each control signal packet includes a vehicle identification tag (ID1, ID0) which associates each control signal packet with the toy vehicle 10 associated with that remote radio controller 12. Further details concerning the manner in which signal packets are set up for controlling a remotely controlled toy vehicle may be obtained from co-pending U.S. patent application Ser. No. 10/046,374, filed Jan. 14, 2002, now U.S. Pat. No. 6,848,968 the complete disclosure which is hereby incorporated herein by reference.

The radio controller 12 also includes a transmitter, in the presently preferred embodiment a radio frequency transmitter including an oscillator 422, a crystal 424 for the oscillator 422, a radio frequency amplifier 426, a matching circuit 428 and an antenna 430, for transmitting the generated control signal packets 132, 136 to the toy vehicle 10. It will be appreciated by those of ordinary skill in the art that some other type of transmitter, such as an infrared transmitter, could alternatively be employed.

Time Division Multiplexing Scheme

As stated above, the present invention comprises a game in which as many as four toy vehicles 12, each under the control of a different user, are simultaneously employed to play against each other. Accordingly, each toy vehicle 12 must be separately and independently controlled from each of the other toy vehicles without incurring interference between control signals. In the present embodiment, the streams of control signal packets are transmitted on the same carrier radio frequency for all four of the vehicles. Therefore, time-division multiplexing (TDM) is employed, with each controller being assigned a separate transmission "window" 141, 142, 143, 144, respectively, during a prescribed time cycle TC. The time cycle includes sufficient "dead" time 146 between the transmission windows so that there is no overlap between the transmission windows, even over the course of the game as windows slowly drift relative to one another. The use of time-division multiplexing requires synchronization and calibration of the several radio controllers 12 to calibrate/adjust for different crystal speeds at the beginning of play so that the transmission windows for each radio controller 12 are scheduled to happen at different times in order to avoid transmission collisions.

From experience it is known that a toy vehicle 10 must receive an updated control signal packet from its corresponding radio controller 12 approximately every 100 milliseconds. At a slower update rate, the toy vehicle 10 behaves sluggishly. This means that for four vehicles to be controlled using the same frequency and to avoid collisions, each toy vehicle 10 can be allotted a transmission window which is no larger than twenty-five milliseconds. Since, during play, some drift in the transmissions may occur due to the normal timing drift, the actual control signal packet length must be less than twenty-five milliseconds.

In the present embodiment, eighty-eight milliseconds has been chosen as the time of a complete transmit cycle TC. Within the eighty-eight milliseconds, each transmitter (e.g., radio controller 12) has fourteen milliseconds of transmission, such that transmission windows have a single, common transmission window length TL, followed by seventy-four milliseconds of non-transmission as shown in FIG. 13*c*. Between each transmission window 141, 142, 143, 144 is an eight millisecond period of dead time 146. By providing an eight millisecond dead time, a transmission window may drift up to eight milliseconds in either direction relative to the adjacent window without colliding with the transmission of another control signal packet 132, 136.

In the prior art are remote control toy vehicles using biphase encoding with each transmit element comprising one-half of a bit, a typical bit rate of 1.5 kilobits per second (transmit element of 333 microseconds). In order to accommodate the required control signal packet as well as the time division multiplexing scheme, the bit rate for the presently preferred embodiment has been increased to six and one half kilobits per second—each transmit element having a width of seventy six and one half microseconds. By increasing the bit rate in this manner, three and one-half control signal packets 132, 136 can be sent in each fourteen millisecond transmission window 141, 142, 143, 144. Since one-third of a control signal packet is required for synchronization of the hardware and firmware (referred to as warm up), essentially six complete control signal packets 132, 136 may be sent during a given transmission window. If at least two sequential control signal packets are identical when received and decoded by the central controller 300, the received control signal packets are considered to be valid and the operation of the toy vehicle 10 is actuated accordingly. When transmitting both drive data packets 132 and fire data packets in alternating fashion in the same stream 140 (FIG. 13*b*), the received control signal packets will be deemed valid if the next sequential packet of the same type is identical. Sending multiple control signal packets in the same transmission window in this manner is desirable because it permits packet level error checking, thereby significantly reducing transmission error.

Figure 14A:
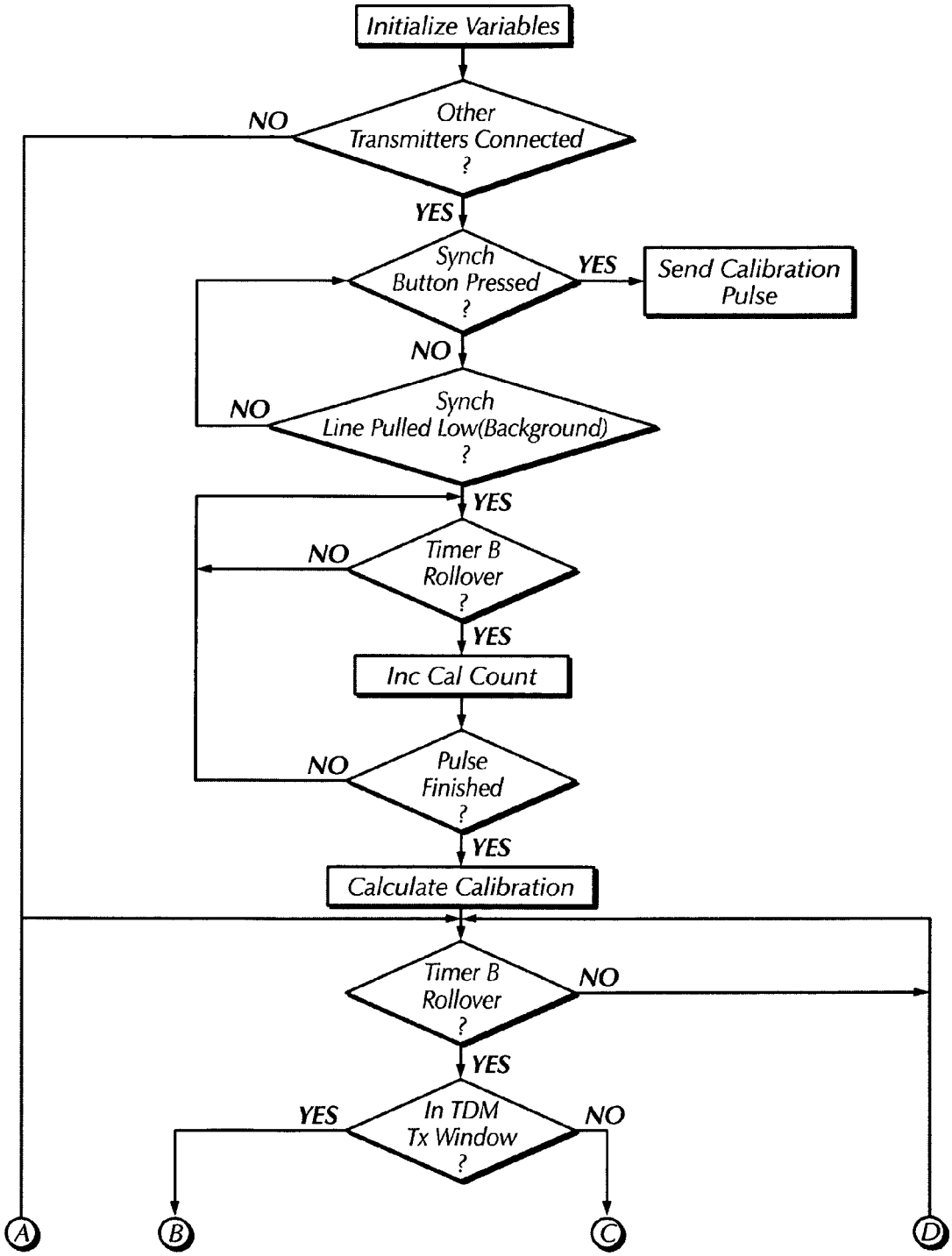
FIGS. 14*a*, 14*b* and 14*c* are flow diagrams illustrating the operation of a portion of the firmware of the transmitter circuitry of FIG. 4.
Figure 14B:
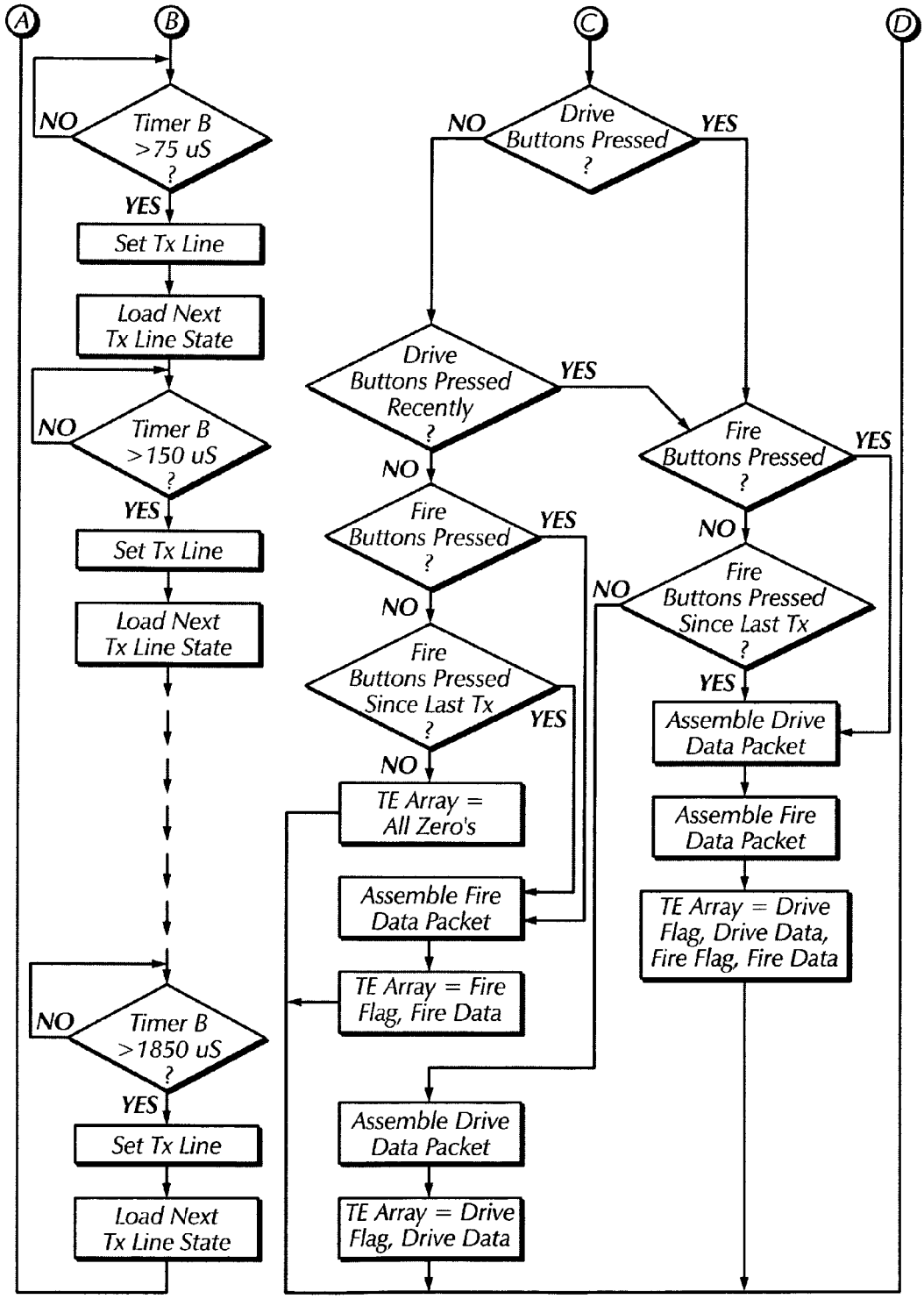
Figure 14C:
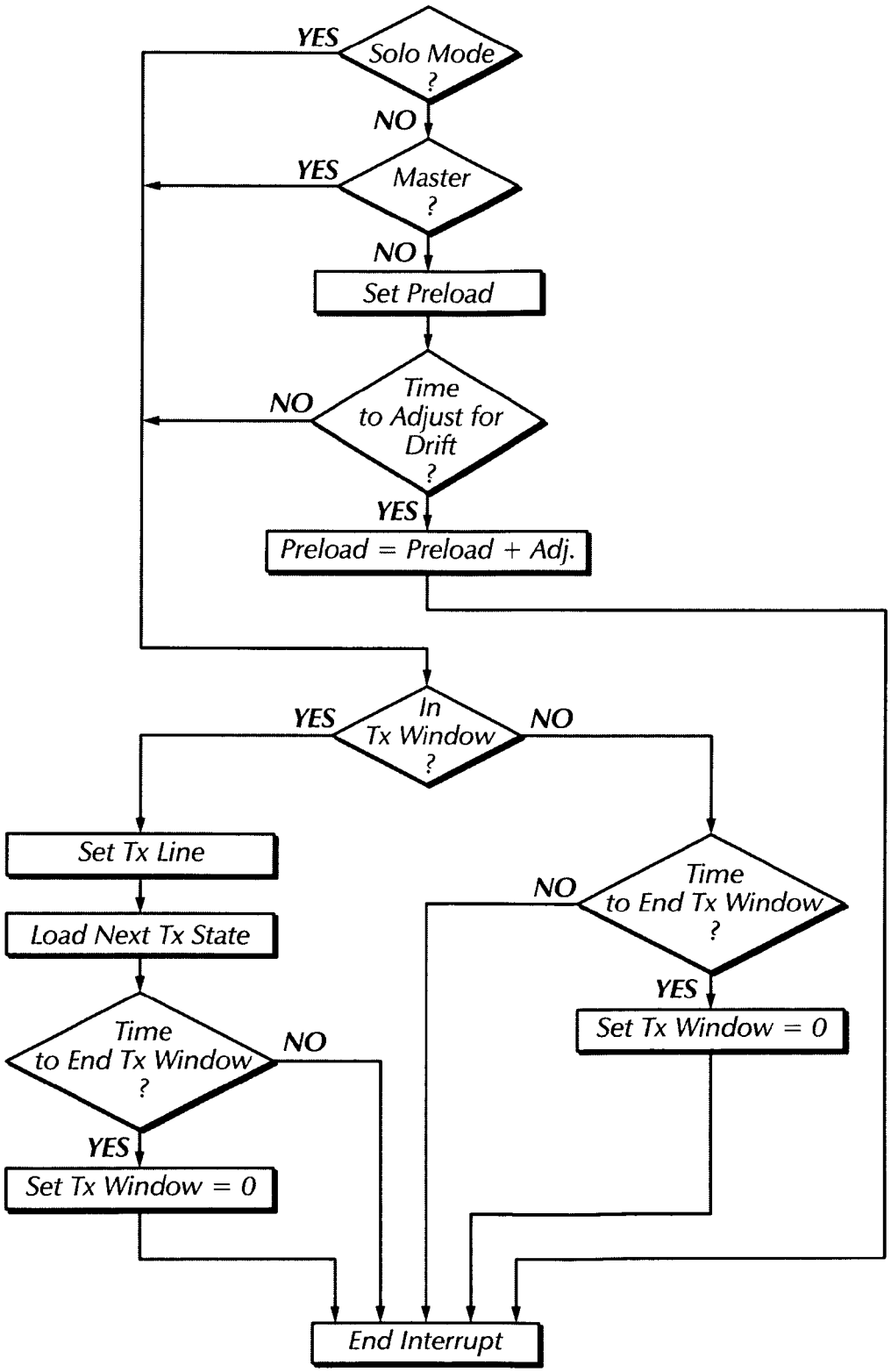

In order to avoid transmission collisions, the radio controllers 12 must be synchronized at the beginning of play so that their transmissions are all scheduled to happen at the appropriate, spaced times. The transmission windows must also not drift during play to the extent that transmissions from two or more of the remote radio controllers 12 could overlap. Synchronization is accomplished by physically plugging together the up to four remote control units prior to transmission of streams of control signal packets (i.e., prior to the beginning of play) using a pair of synchronization ports 432, 434 on each radio controller 12. Once the four remote radio controllers are plugged together, they are turned on and a synchronization button (not shown) on one of the radio controllers 12 is depressed to initiate the synchronization process. The radio controller on which the synchronization button is depressed becomes the master and generates a timed pulse on a synchronization line. The other radio controllers are considered to be "slave" units and use the timed synchronization pulse to establish their respective transmission windows at a fixed amount of time after the end of the master synchronization pulse depending upon the identity of the radio controller and to calibrate their processor speeds relative to the processor speed of the master in order to adjust for drift. The slave radio controllers calibrate by measuring the synchronization pulse and using the difference between the measured pulse length and the nominal pulse length (how long the pulses would be if the remote control units ran at exactly the same speed) to calculate an adjustment. During normal play, the slave remote radio controllers use the calculated adjustment to minimize drift. After calibration is completed, the radio controllers move into normal operation. FIGS. 14*a*, 14*b* and 14*c* are flow diagrams that illustrate the synchronization process.

Weapons

Figure 5:
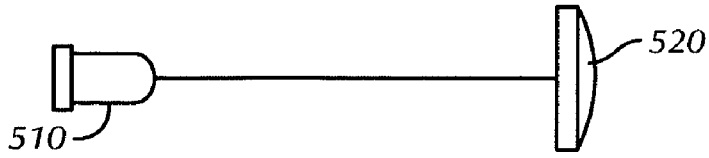
FIG. 5 is a side elevational view of a portion of a simulated weapon.

The preferred exemplary toy vehicle 10 further includes a simulated weapons system indicated generally at 308 compromising at least one remotely controlled "weapon" simulative of a weapon employed in an actual fighting vehicle. In the presently preferred embodiment, the toy vehicle 10 includes a first light cannon-like weapon in the form of a front firing narrow beam infrared emission source 310 and a second light cannon-like weapon in the form of a rear firing broad beam infrared emission source 312. The front emission source weapon 310 is used for long range narrow beam targeting while the rear emission source weapon 312 is used for short range spread beam targeting. Preferably, both infrared emission source weapons 310, 312 operate with a carrier modulation frequency of about 40 kHz and with a physical optical wavelength of between about 880 and 900 nm. Other modulation frequencies and/or optical wavelengths may be employed. The front firing emissions source weapon 310 preferably uses a narrow half power beam angle infrared light emitting diode (LED) 510 (FIG. 5) of a type well known in the art which is aligned with a single convex lens 520 to create an effective focal length in the range of 35 mm. Preferably, the lens 520 is made out of an acrylic material and is separated from the infrared LED 510 by about 38 mm. As a result, the front emission source weapon has the capability of "firing" an infrared beam up to about 4.25 meters (fourteen feet) with the beam including a diameter, at 4.25 meters, of about 115 mm.

The rear emission source weapon 312 also includes an infrared LED. However, because no focusing lens is provided, the range of the rear emissions source weapon is limited to approximately 0.8 to 0.9 meters (about three feet or less) and the diameter of the infrared signal at 0.85 meters is approximately 0.6 meters. Thus, the front firing emissions source weapon 310 may be used for firing precise beams over relatively long distances whereas the rear firing emission source weapon 312 is capable of firing a much wider beam path but only for a relatively short distance. The firing of both the front firing emission source weapon 310 and the rear firing emission source weapon 312 is controlled by a user using one or more appropriate manual control buttons on the hand-held remote control unit 12 in a manner which will hereinafter be described in greater detail. The infrared beams fired by both the front firing emissions source weapon 310 and the rear firing emission source weapon 312 may be used when playing a game to simulate the damaging or destruction of other toy vehicles playing the game in a manner which will hereinafter be described. The front firing emission source weapon 310 and the rear firing emission source weapon 312 can be activated regardless of whether the toy vehicle 10 is stationary or moving and without regard to the direction of movement of the toy vehicle 10.

Damage Sensing

The toy vehicle also includes one or more infrared receiver modules, or "damage sensors" 314 for sensing when the toy vehicle has encountered a "hit" as a result of receiving an infrared beam "fired" by an enemy weapon from an "opponent" (i.e., another toy vehicle or an autonomous enemy game piece). In one embodiment of the toy vehicle 10, four separate infrared sensors are provided one each on the front, rear, left and right sides of the toy vehicle. FIG. 1 shows the damage sensors 22, 24 on the rear and right side of the toy vehicle 10, respectively. The infrared damage sensors may be conventional IR optical receivers or any other element generally known in the art to detect a directed light beam.

Figure 6:
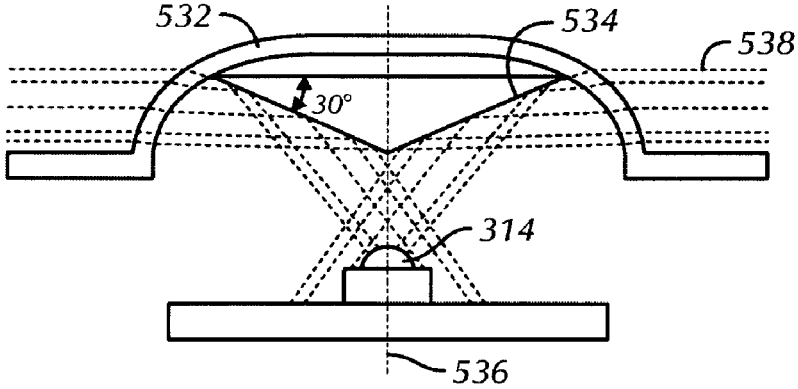
FIG. 6 is an elevational view of an infrared receiver dome.

In another embodiment, a generally transparent infrared receiver dome 530 (FIG. 6) is located on the top or upper surface of the toy vehicle 10. The receiver dome 530 includes a generally semispherical transparent cover 532 preferably made of an acrylic transparent material which encloses and covers a substantially conical reflective surface 534 having a central axis of rotation 536. The apex of the conical reflective surface 534 faces downwardly into the toy vehicle 10. The conical reflective surface 534 preferably has a base of approximately 25 mm and an angle of approximately 30°. Other angles and base dimensions may be employed. A single infrared receiver module, or damage sensor 314 with a center frequency which corresponds to the frequency of the infrared emissions source weapons 310, 312 is located within the toy vehicle 10 at a predetermined distance beneath the apex of the conical reflective surface 534. In this manner, the combination of the conical reflective surface 534 and the transparent dome 532 cooperate to focus and direct downwardly toward the infrared sensor 314, infrared light 538 received from any generally horizontal direction. This arrangement blocks a large percentage of downwardly directed extraneous background radiation that would otherwise saturate or adversely affect the damage sensor 314 yet allows generally horizontally traveling infrared signals, such as the type of signals that would be emitted by the simulated weapons 310, 312 from an opponent to be focused and reflected onto the infrared sensor 314 within the toy vehicle 10. Preferably the infrared sensor 314 or receiver is a PIC 1018 available from Waitrony Co. Limited of China and Hong Kong. Upon receipt of an infrared signal, the damage sensor 314 within the toy vehicle 10 provides an electrical output signal to a microprocessor control unit (MCU) 316 of the control system 300 on board the vehicle 10. The damage sensor 314 outputs demodulated digital signals, a "1" or a "0" based upon whether the received infrared radiation exceeds predetermined amplitude threshold criteria. In this manner, infrared noise within the playing area is not sufficient to produce an output signal unless its amplitude exceeds the threshold criteria, the modulation falls within the bandpass characteristics of the sensor and the wave length of the source is within the operating characteristics of the sensor.

Figure 7:
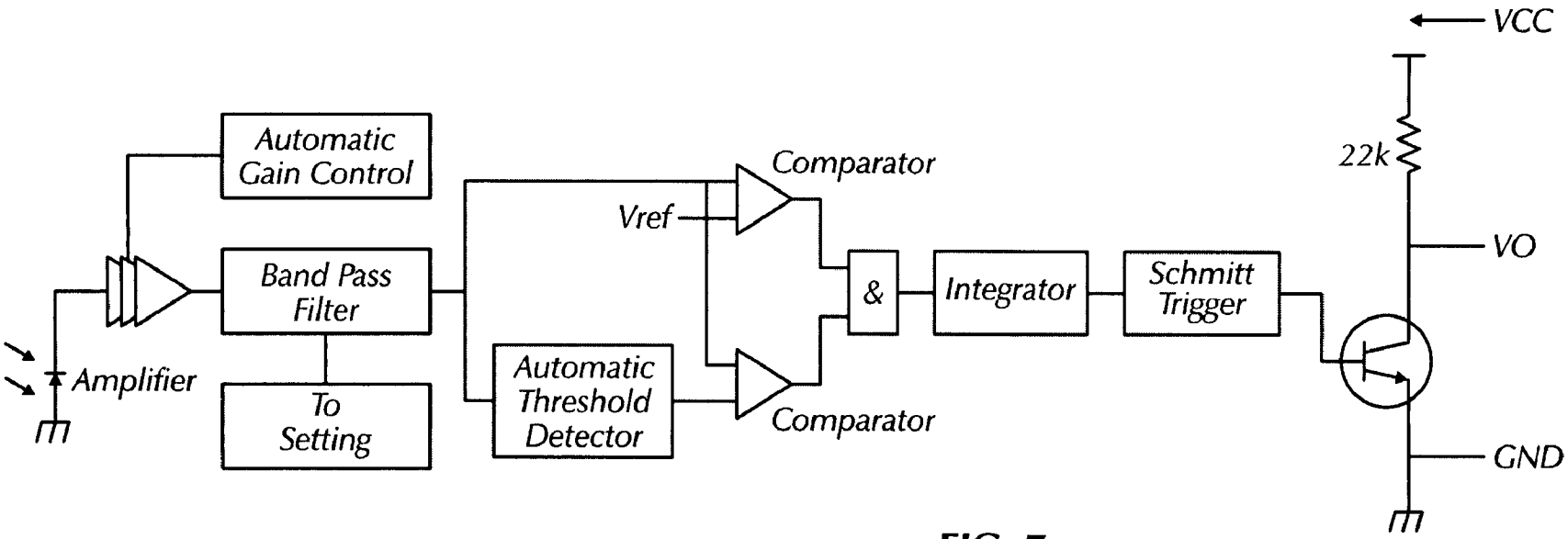
FIG. 7 is a schematic of the infrared sensor circuit.

FIG. 7 is a circuit diagram of the infrared sensor circuitry. The MCU 316 of the control system 300 on board the toy vehicle 10 determines, based upon the signal received from the damage sensor 314, the extent of the simulated damage sustained by the toy vehicle 10 as a result of being "hit" by the infrared beam from the weapon of an opponent. The complete destruction of a toy vehicle 10 may end a game, at least for the player whose toy vehicle 10 received the hit whereas a toy vehicle 10 which has received only minor or collateral damage may be permitted to continue to play the game, perhaps with a penalty.

Tag Bases

Figure 9:
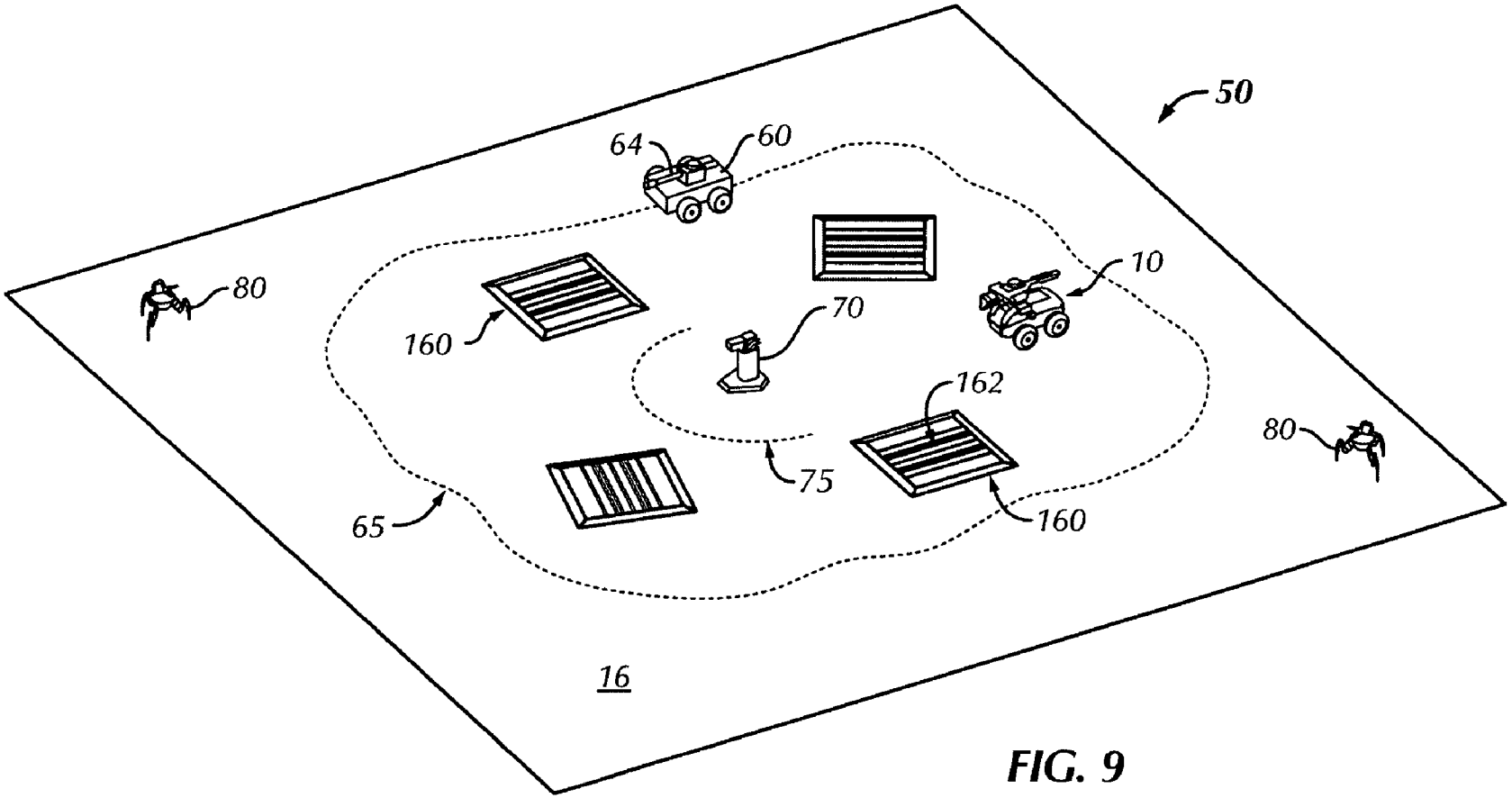
FIG. 9 is a top perspective view of the game system according to the present invention.

The game with which the toy vehicle 10 is used contains at least one "tag base" such as exemplary tag base 160 (FIG. 16) and preferably a plurality of tag bases which are strategically placed at selected locations throughout the area or playing surface 16 on which the game is to be played (FIG. 9). The tag bases 160 are formed of tags 161 placed on a generally flat mat or pad 163 which is sufficiently thin to be driven over by a toy vehicle 10. Each pad 163 has at least one tag 161 on an upper surface 165 thereof. Preferably, each tag 161 is small (no larger than 4"×4"), symmetrical, about the thickness of a sheet of paper and made of a polymeric material. In an alternative embodiment, several tags 161 may be removeably placed on or integrally formed with a substantially larger mat or pad 163' which forms the playing surface 16 on which the game is played. Because the tag bases 160 are of the passive type, no separate power supply is required.

Figure 16:
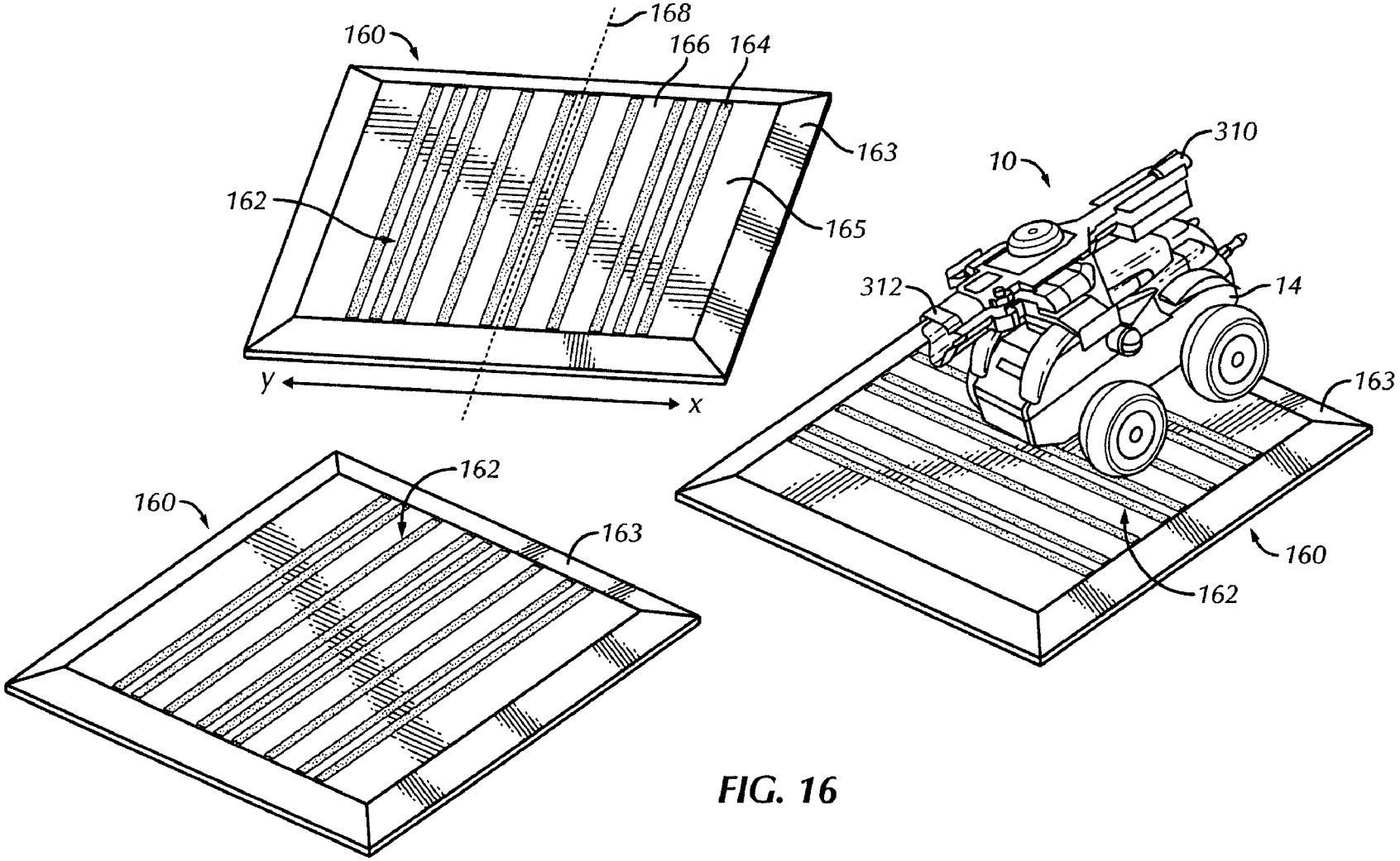
FIG. 16 is a perspective view of several preferred tag bases showing implementations of reflective patterns.

Each tag 161 incorporates a readable, pre-determined reflective pattern 162, or barcode, which is encoded with information 170 which, in the preferred system being described, identifies an operational mode 350 of the toy vehicle 10 that is associated with the tag base 160. As shown in FIG. 16, the reflective pattern 162 in a preferred embodiment is formed by a series of "marks", or substantially non-reflective portions 164 which are separated by or interspaced with a series of "spaces", or more highly reflective portions 166. The marks 164 are implemented by a rough textured substantially non-reflective (e.g. matt) surface, which functions to scatter light. The spaces 166 are implemented by a more highly polished or reflective surface which reflects light. The reflective pattern 162 and at least the surface 165 within the pattern and/or the pad 163 are preferably monochromatic meaning marks and spaces between them are the same color. Monochromatic is intended to include monotonic (e.g. all back, all white or all gray).

The pattern of the marks and spaces of the reflective pattern 162 of a tag 161 are the same in the two principal opposing directions x, y (left or right when viewing FIG. 16), such that the pattern 162 may be read as the toy vehicle 10 passes over the pattern 162 from either principal direction x, y. Stated differently, the pattern 162 on a tag 161 is symmetrical about a central axis 168.

Figure 20:
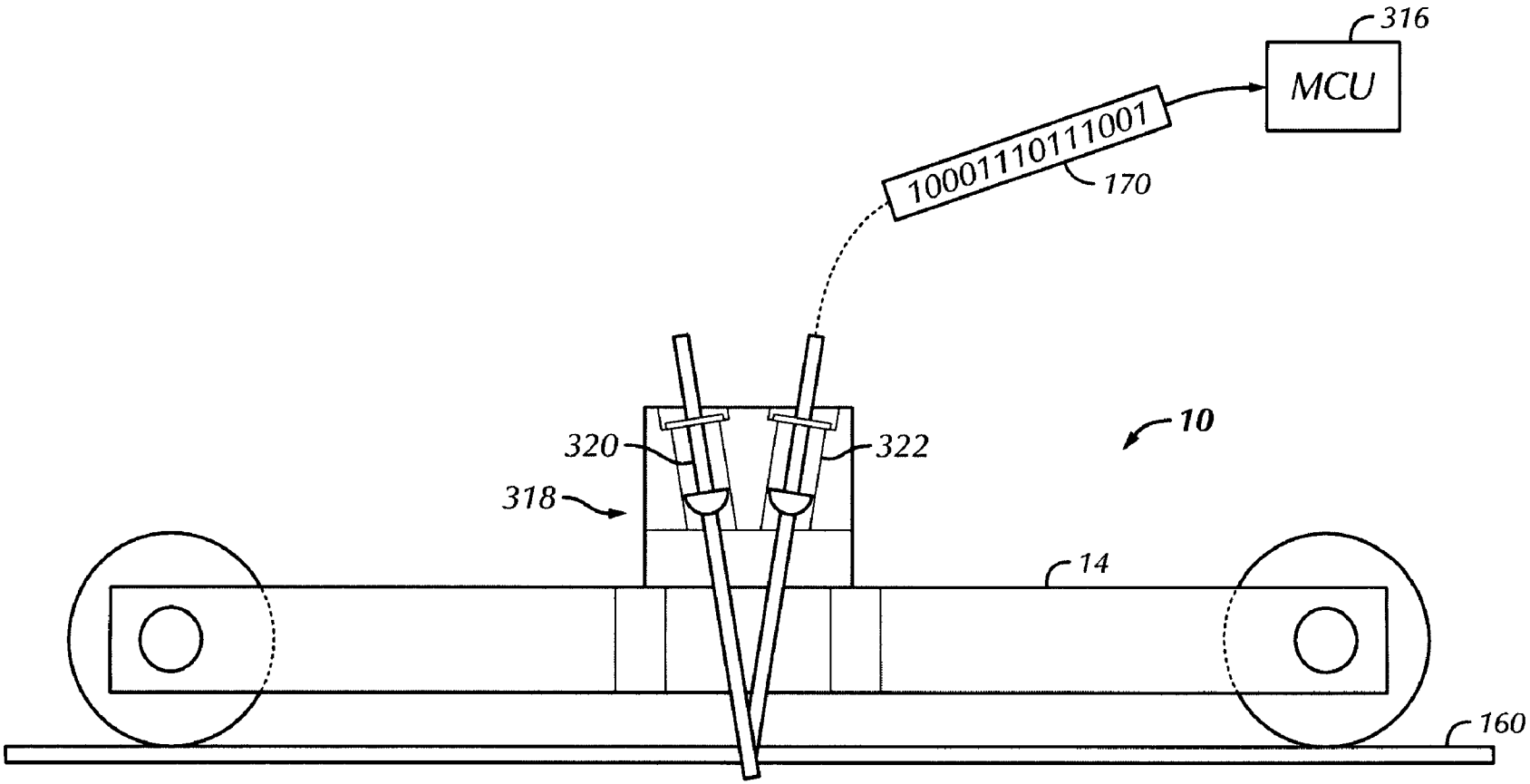
FIG. 20 is a side view of a toy vehicle showing the tag reader in accordance with the present invention.

In the preferred embodiment, the toy vehicle 10 preferably includes a downwardly looking tag reader 318, such as an infrared bar code scanner, mounted to the mobile platform 14. The tag reader 318 preferably includes an IR emitter, or light transmitter 320, an IR collector or optical receiver 322 (see FIG. 20) and an amplifier 324. The emitter 320 and the receiver 322 are mounted within the toy vehicle 10 at angles such that the light beams associated with the emitter 320 and receiver 322 intersect each other such that the tag reader 318 is at the appropriate distance from the surface 16 for reading the pattern 162. The optical receiver 322 is preferably configured to read the reflective pattern 162 when the toy vehicle 10 traverses the reflective pattern 162 in a direction which is generally perpendicular to the central axis 168 (i.e., either of the two principal directions x, y). Thus, since the reflective pattern is symmetrical about the central axis 168, the tag reader 318 may read the reflective pattern 162 when the toy vehicle is when moving in either a forward or rearward direction over the tag base 160. By having the toy vehicle 10 pass over the pattern 162 of a tag base 160 within a prescribed angle of either of the two principal directions x, y (left or right), the pattern 162 may be read by the infrared tag reader 318 for enabling the particular feature or operational mode associated with the pattern 162 read from the tag 161. Since a tag 161 has marks 164 and spaces 166 which have differing light reflecting qualities as described above, the ability of the tag reader 318 to differentiate between the marks 164 and spaces 166 and thus "read" the pattern 162 is enhanced.

The tags 161 include coded information 170 which is associated with one or more operational modes 350 of the toy vehicle 10. The toy vehicle has a variety of modes which, when activated or deactivated, collectively define the vehicle's powers and/or capabilities. For example, one operational mode may grant the toy vehicle a particular armor strength or level. Additional categories of operational modes include weapons strength, speed and steering capabilities, fuel levels and the ability to employ hazards for an opponent. At least one of the numerous operational modes of the toy vehicle is altered when the vehicle passes over a tag base 160, thereby giving the toy vehicle an advantage (or disadvantage) in playing the game, at least for a pre-determined time period, with respect to other opponents in the game. The vehicle(s) 10 might start with only nominal rather than maximum characteristics including speed/steering which can be maximized or minimized by passage over a tag base. For example, passing over a tag base may create stronger armor for the toy vehicle 10 causing it to be less susceptible to sustaining damage when attacked by another toy vehicle. Alternatively, the tag base 160 may give the toy vehicle 10 the capability of employing a hazard, such as an oil slick from the rear of the toy vehicle, or other weapon/defensive advantages causing any pursuing vehicles to lose steering control, speed or otherwise become disrupted or disabled for a predetermined time period. This would be accomplished by having the rear firing emission source broadcast a coded signal (e.g. a pulsed signal) that could be received and decoded by the following vehicle(s) and cause such vehicle(s) to reprogram a disability into itself. Other special effects which add increased interest to the playing of the game may also be employed.

Preferably, each tag base 160 includes indicia (not shown) in the form of a color code or other marking (e.g. basic monotone colors) to provide a user of with knowledge of the operational mode (i.e., green for advantage or red for disadvantage) which may be obtained by having the toy vehicle 10 pass over the tag base 160.

Figure 17:
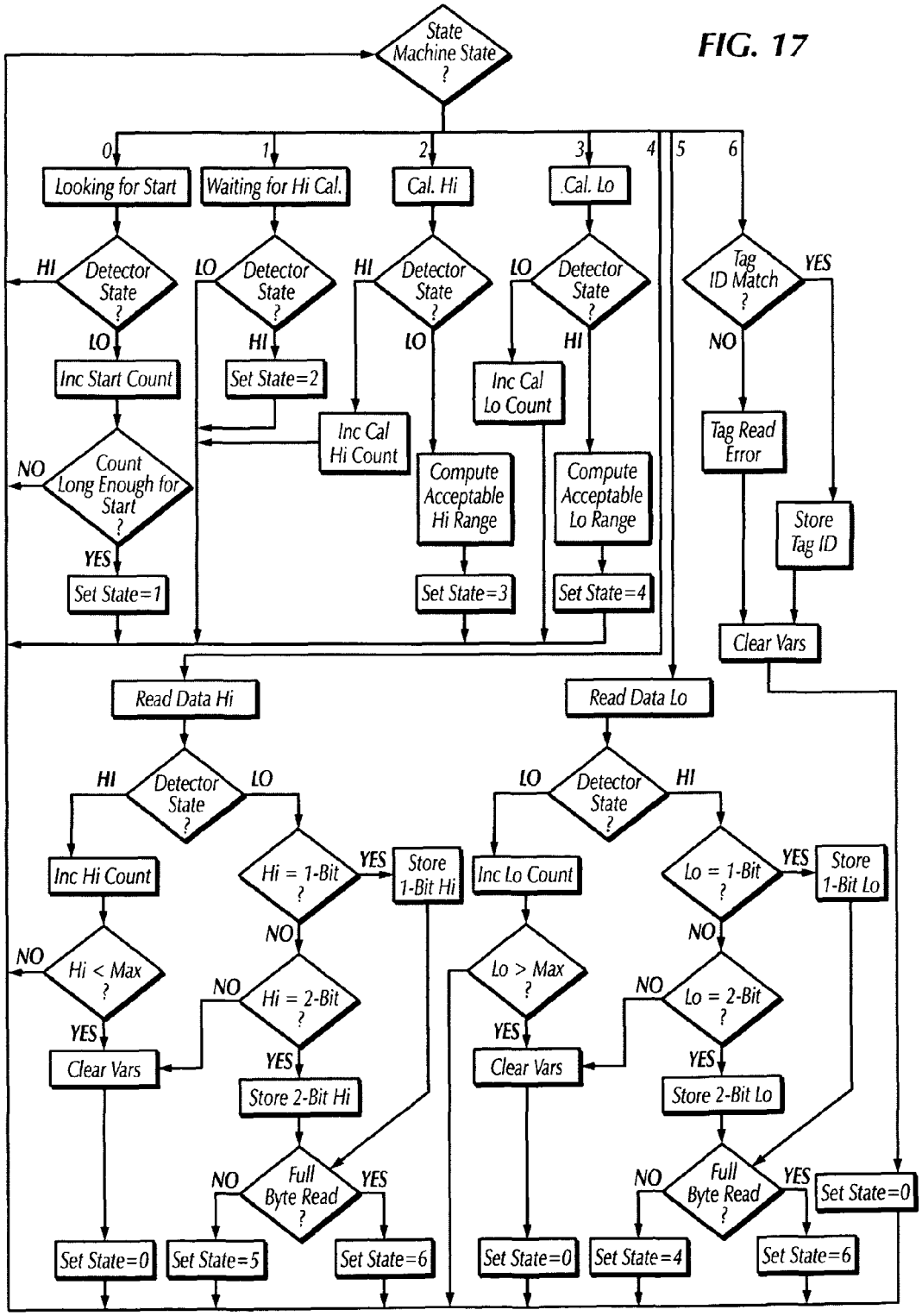
FIG. 17 is a flow diagram illustrating the functioning of the control system in reading and implementing a read reflective pattern.

A flow diagram showing the operation of the control system 300 in reading a pattern 162 is set forth in FIG. 17. Output signals from the tag reader 318 are provided to the MCU 316 for processing. Whenever a tag base 160 is read utilizing a bar code reader 318, a decoded output signal from the reader/receiver 318 is sent to the MCU 316 of the on-board vehicle control system 300 for implementation. The MCU 316 receives the decoded tag base signal (the coded information 170) and takes appropriate action for implementing the corresponding operational mode 350 or feature afforded by the tag base 160. Implementing a new operational mode 350 as the result of reading a tag 161 has the effect of at least partially re-programming the central controller 300. That is, when the central controller 300 determines what the coded information 170 from the tag 161 represents, the controller 300 partially alters the executable code which it uses to effect operation of the toy vehicle 10. The manner in which the controller 300 is re-programmed is consistent with the new operational mode 350. The toy vehicle 10 further includes a series of visible indicators such as LEDs 326 which are illuminated by the MCU 316 to show the user the status of the features or operational modes enabled or actuated.

Figure 8:
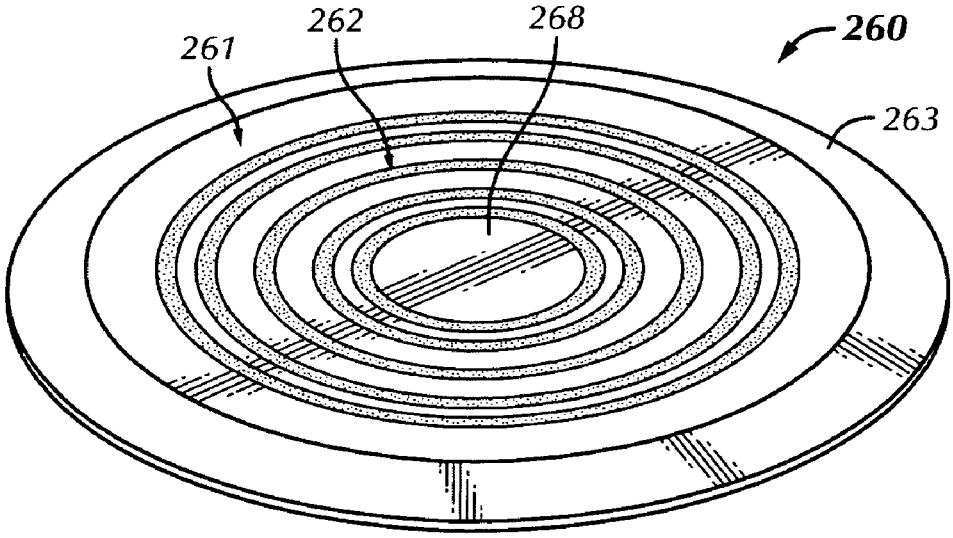
FIG. 8 is a top perspective view of an alternative embodiment of a tag base having an encoded reflective pattern in accordance with the present invention.

In an alternative embodiment, the tag bases 260 and tags 261 may have a generally circular shape, generally resembling a bull's eye design (see FIG. 8). The tags 261 are similar to the tags 161 with the exception that the marks 264 and spaces 266 are formed from concentric rings around the center 268 of the pattern 262. In this embodiment the optical reader 322 is configured to read the pattern 262 when the toy vehicle passes within a pre-determined distance of the center 268 of the pattern 262. The advantage of bulls-eye tags is that they can be approached from any direction. The disadvantage is that the vehicle must pass over the tag much closer to its physical center than is necessary with the bar code tags 161. It will be appreciated that either type of pattern (bar code of parallel bars 164, 166 and bull's eye of concentric rings 264, 266) will be read as long as the vehicle crosses the central axis of symmetry of the tag sufficiently perpendicularly to the central axis. For the bar code pattern 162 this means sufficiently close to parallel to the x, y directions and for the bull's-eye it means sufficiently close to the physical center of the bull's-eye.

It will be appreciated by those of ordinary skill in the art that the concept of employing a tag 161 for the toy vehicle 10 to pass over could be implemented using a technology other than the scanning or reading of a pattern. In addition, game features other than those specifically discussed above could also be employed.

One Player Games

In order to permit a single player/user to enjoy meaningful playtime with the toy vehicle 10, the present invention further comprises separate, enemy (opponent) beam weapon firing toy devices in the form of "droids". In the present embodiment there are three different types of droids: mobile droid vehicles, stationary droids and border droids.

Figure 15:
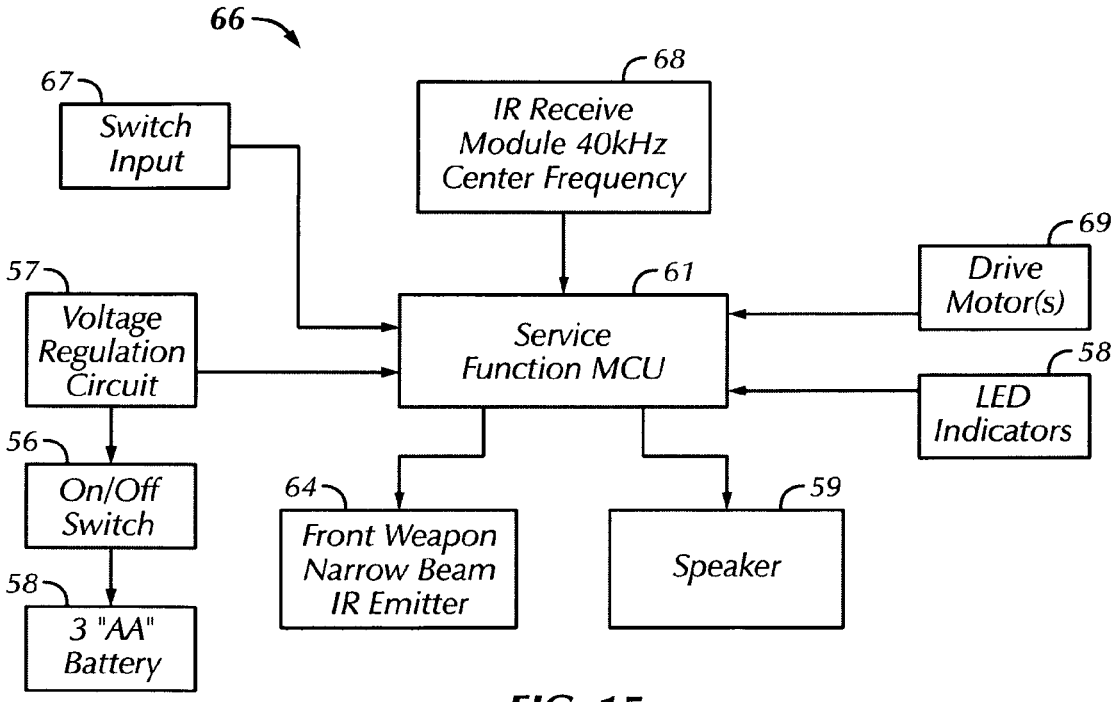
FIG. 15 is a functional schematic block diagram of the control system of a mobile droid used in the present invention.

Each mobile droid vehicle 60 takes the form of a mobile platform 62 (see FIG. 9) configured to move over the playing surface 16, preferably on wheels or rollers. The mobile droid vehicle further includes one or more enemy weapons 64 mounted to the platform 62. The enemy weapon is preferably in the form of an infrared cannon which fires from the front of the mobile droid vehicle 60. The mobile droid vehicle 60 further includes an on-board mobile droid controller 66 as shown in FIG. 15, which controls the operation of suitable drive and steering motors 69 as well as the enemy weapon 64. The moving droid 60 may include tank-style steering to permit it to turn quickly in different directions. The controller 66 further includes a microcontroller 61 with a memory in which is stored a plurality of preprogrammed movement paths and preprogrammed firing sequences. In addition, the moving droid may be provided with a three position switch 67 that permits the player to set the defenses/"armor" on the moving droid to light, medium and strong. The moving droid further includes an infrared receiver, or droid damage sensor 68 mounted to the platform 62 for permitting the mobile droid vehicle to sustain damages from the simulated weapons of the toy vehicle 10. The mobile droid controller 66 thus is configured to detect hits on the mobile droid vehicle 60 from the vehicle weapon of the toy vehicle 10. The mobile droid 60 may further include a speaker 59 which emits sounds, for example, when firing or in response to a hit on the mobile droid. Additionally, LED indicators 58 may be provided to show the status (for example, damage level) of the mobile droid. The mobile droid is preferably powered by a battery 58. A voltage regulation circuit 57 regulates power to the droid controller 66. The mobile droid 60 may be turned on or off by the switch 56

The described mobile droid vehicle 60 is essentially self-contained and self-operating—i.e., no remote control unit is used with the moving droid. Once the moving droid is turned on and placed in the area of play, the mobile droid controller 66 moves the mobile droid vehicle 60 over the playing surface 16 in one of the predefined patterns 65 while firing the enemy weapon 64 according to its predetermined firing sequence. The toy vehicle 10 must then maneuver and fire its weapons to disable or destroy the moving droid before the moving droid effectively disables or destroys the toy vehicle 10. Alternatively the mobile droid 60 can be configured to track the remotely controlled vehicle 10 in the manner described in U.S. Pat. No. 6,780,077 incorporated by reference herein in its entirety.

Figure 19A:
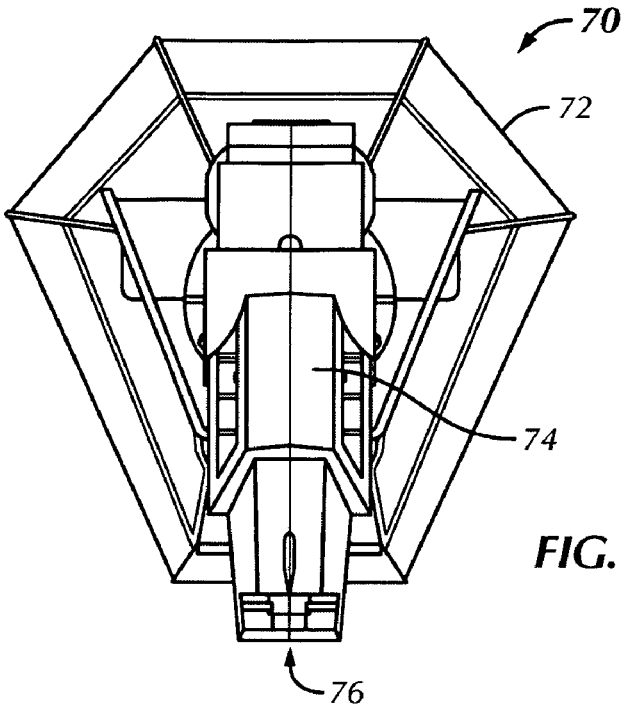
FIGS. 19*a*, 19*b* and 19*c* are top plan, front elevational and side elevational views of a stationary droid.
Figure 19B:
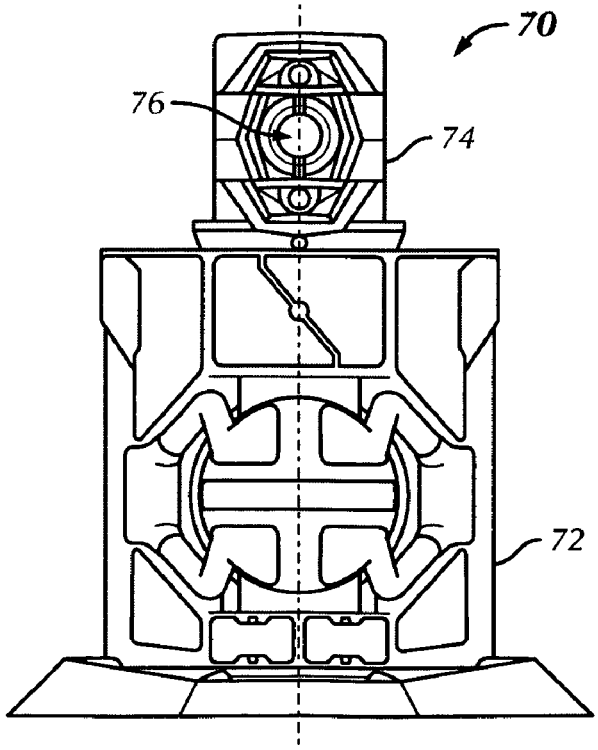
Figure 19C:
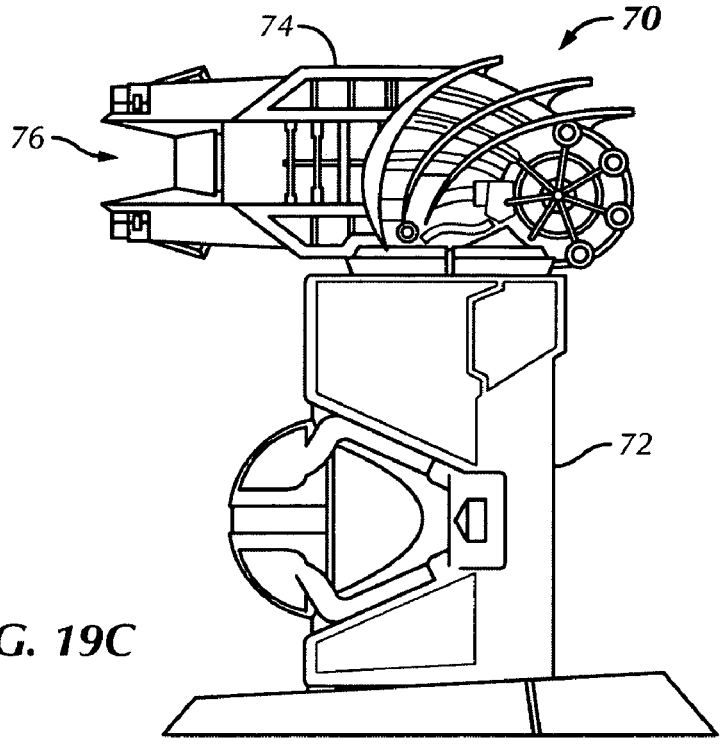
Figure 19D:
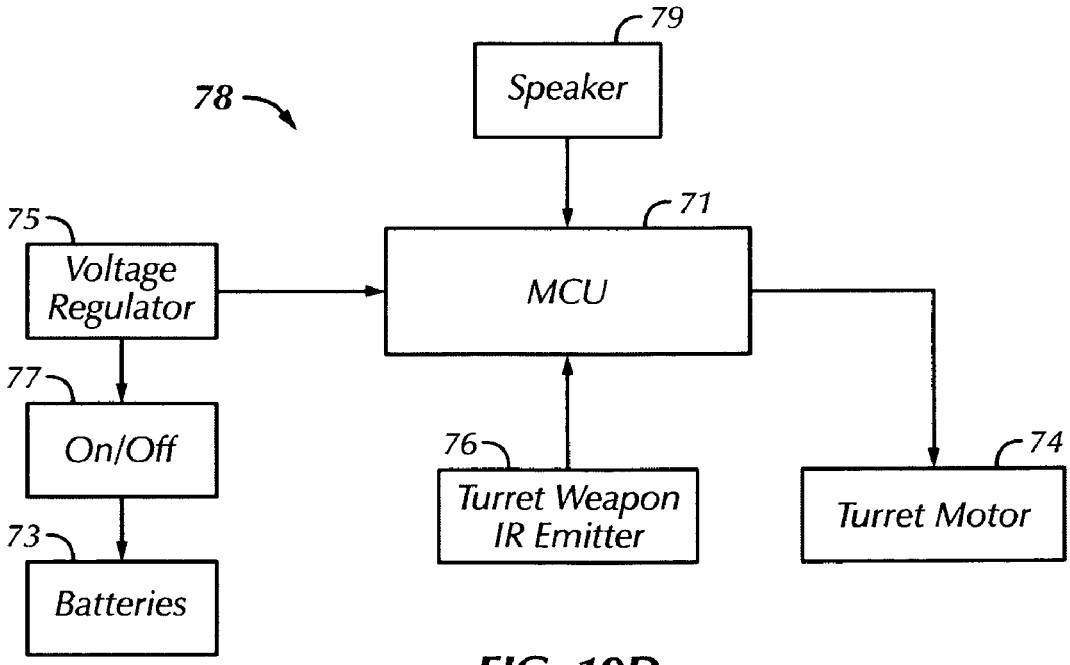
FIG. 19*d* is a functional schematic block diagram of the control system of a stationary droid used in the present invention.

FIGS. 19*a*, 19*b* and 19*c* show a preferred embodiment of a stationary droid 70. The droid 70 includes a non-mobile platform 72 which remains at a single location throughout the game. The stationary droid 70 includes a single rotating turret 74 mounted to the platform 72 and having simulated enemy weapon 76 in the form of an infrared beam firing cannon. The stationary droid 70 includes a stationary droid controller 78 shown in FIG. 19*d*, and includes a microcontroller 71, a speaker 79 and voltage regulator 75. The stationary droid is powered by batteries 73 and is turned on and off by the switch 77. The turret 74 rotates along a predefined path 75 in opposite directions (oscillates) between two limits to establish a predetermined field of fire for the weapon 76 which is fired in a random or partially random manner as the turret 74 rotates. Once the stationary droid 70 is turned on and placed at a fixed location within the play area, it continues to rotate its turret and fires its weapon in the prescribed manner. A control switch or movable stops (not shown) on the stationary droid 70 permits a user to adjust the characteristics of rotation of the turret. The user must maneuver the toy vehicle 10 using the radio controller 12 to avoid being hit by "fire" from the enemy weapon 76 of the stationary droid 70.

Figure 18A:
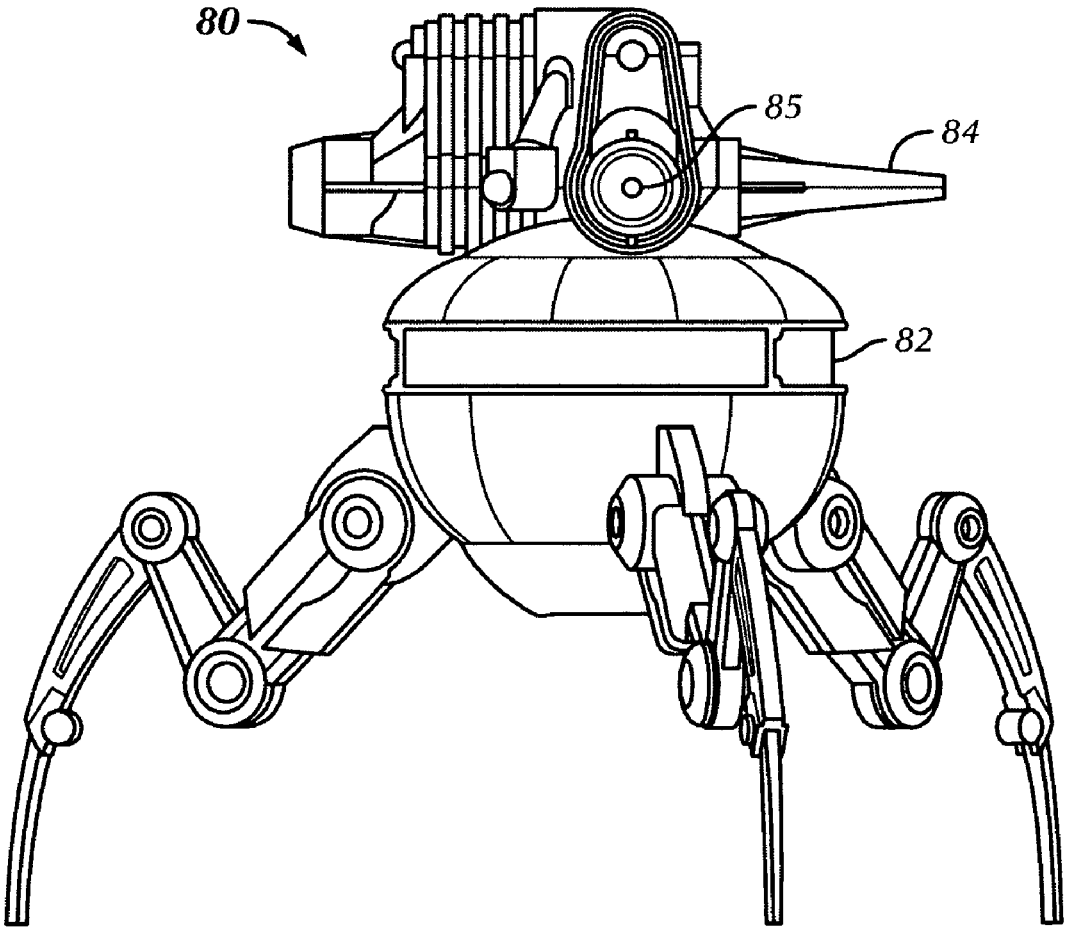
FIGS. 18*a*, 18*b* and 18*c* are side elevational, top plan and exploded view of a border droid.
Figure 18B:
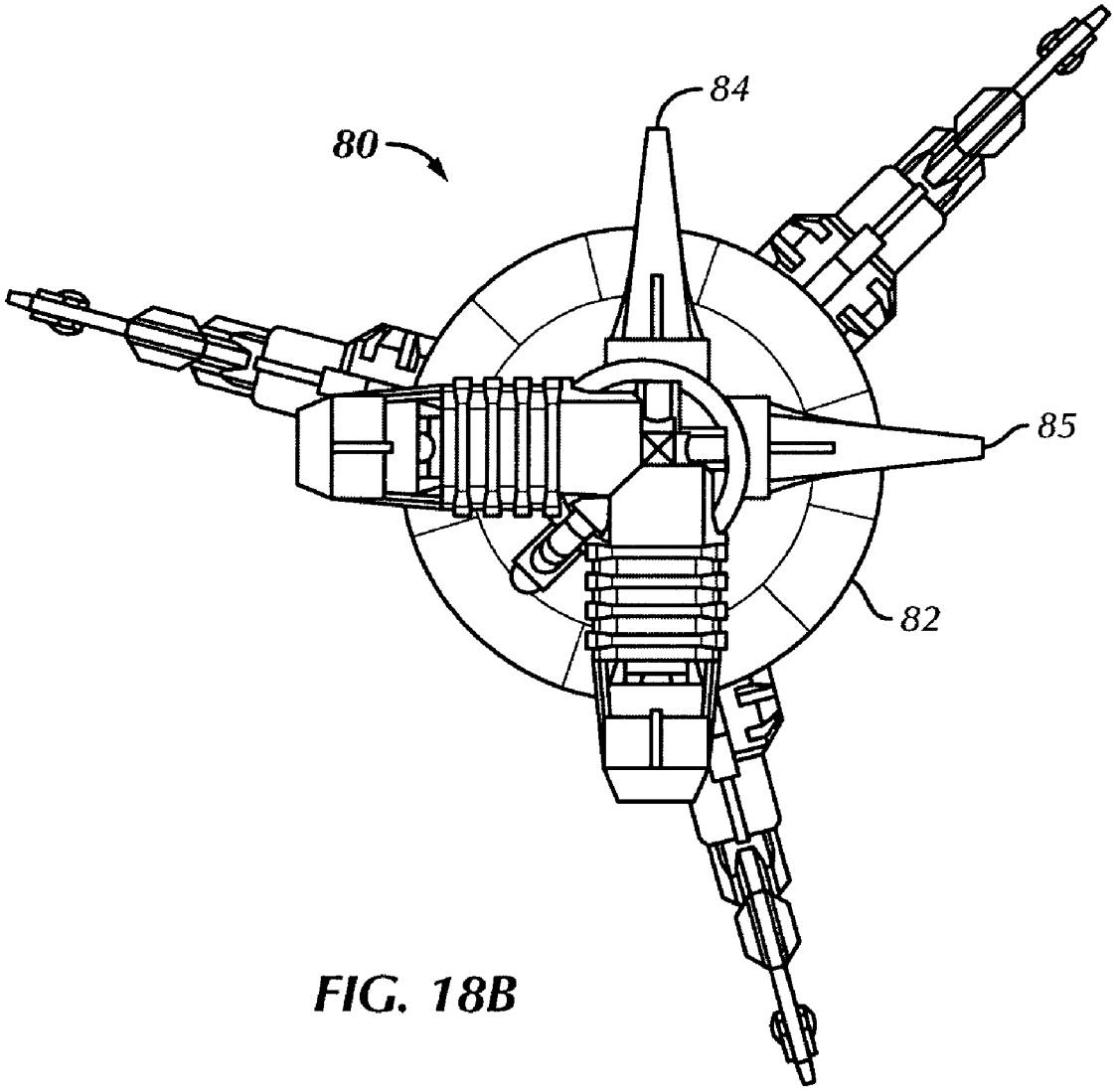
Figure 18C:
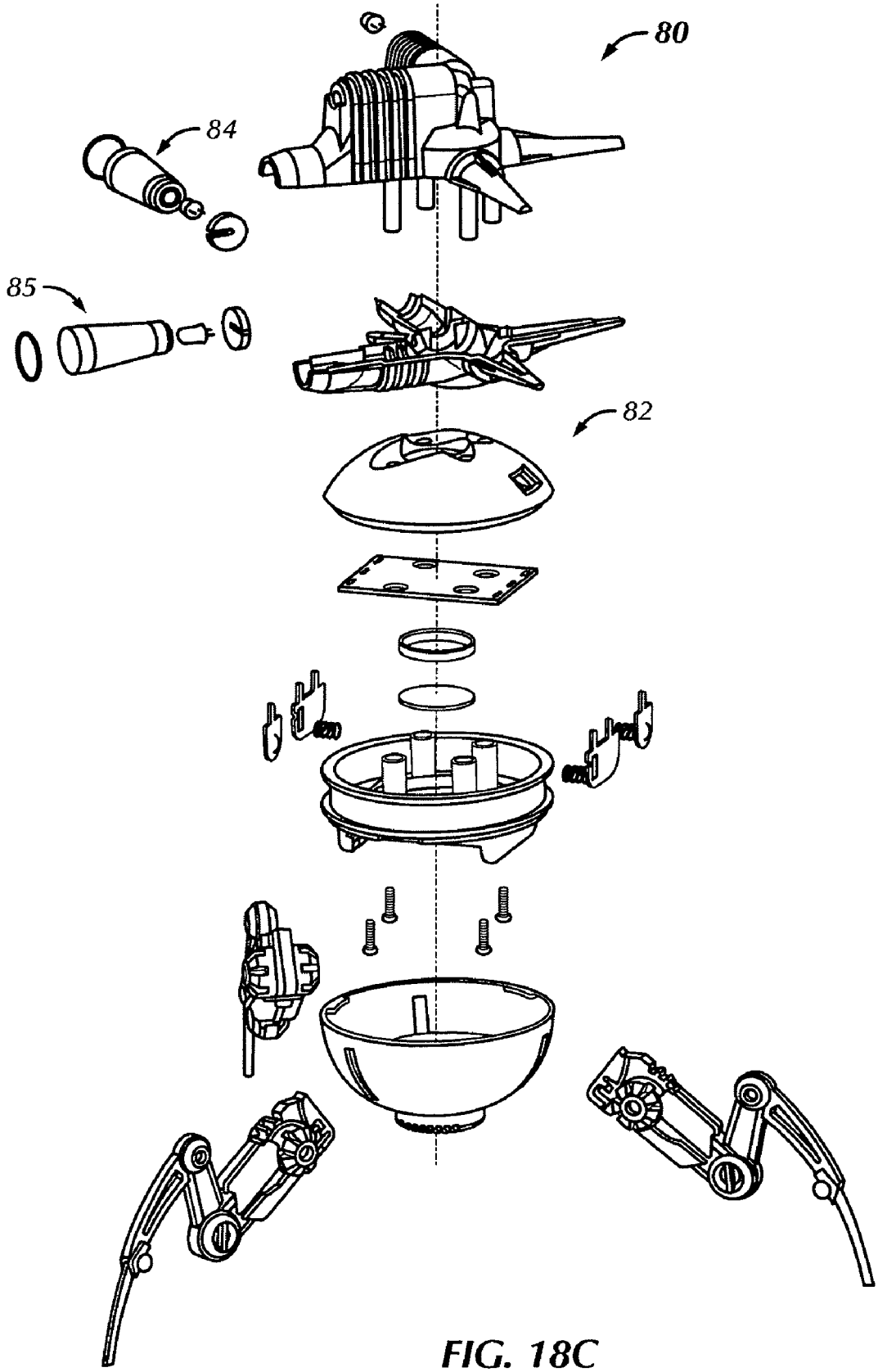
Figure 18D:
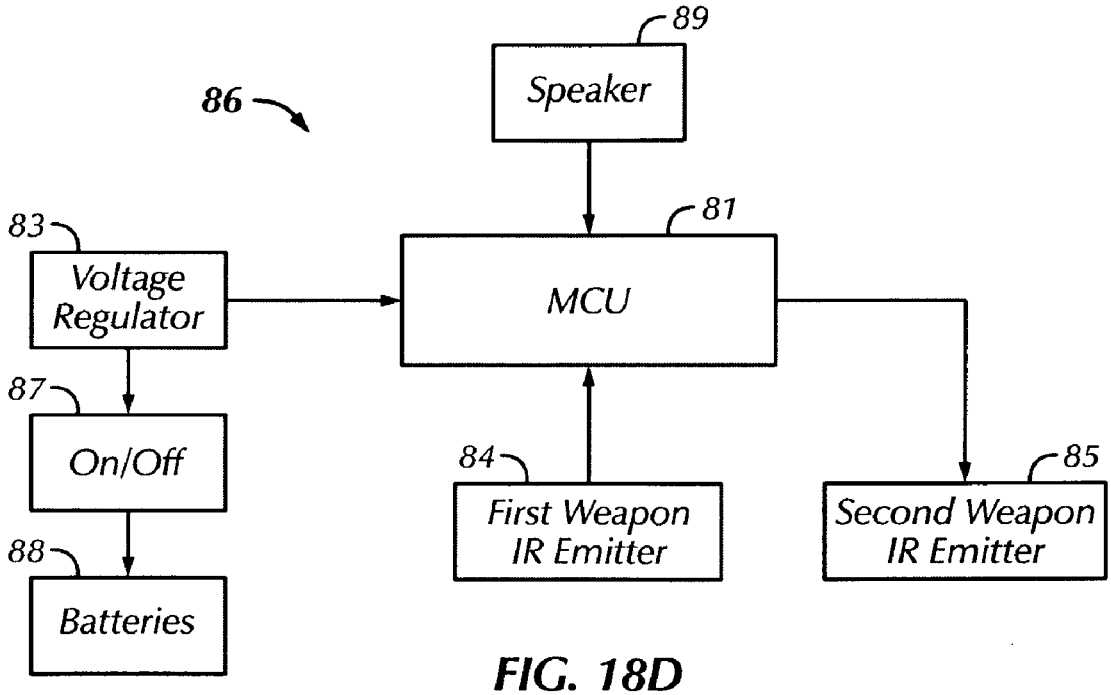
FIG. 18*d* is a functional schematic block diagram of the control system of a border droid used in the present invention.

FIGS. 18*a*-18*c* show a preferred embodiment of a border droid 80 formed from a non-mobile platform 82. The border droid 80 is similar to the stationary droid 70 as described above in that the border droid 80 does not move. However, unlike the stationary droid 70, the border droid 80 has one and preferably two fixed simulated weapons 84, 85, each of which is mounted to fire in a single, fixed direction. The firing directions of the two weapons 84, 85 are preferably perpendicular to each other but could be at other angles and could be adjustable. The weapons 84, 84 of the border droid 80 are both preferably infrared beam firing cannons and are fired randomly or partially randomly in their fixed directions to effectively establish or define a pair of intersecting border lines or boundaries within the play area. The border droid 80 includes a border controller 86, shown in FIG. 18*d*. The border controller 86 includes a microcontroller 81, a speaker 89 and a voltage regulator 83. The border droid is powered by batteries 88 and is turned on and off by the switch 87. Preferably, the border droid is placed at a corner 18 of the playing surface 16, such that the weapons 84, 85 are aligned with two edges 17 of the playing surface 16. Thus, the border droid 80 is used to construct the boundaries of a particular play area. A toy vehicle 10 is at risk of being hit if it attempts to cross either of the boundaries established by the border sentry droid 80.

In playing a single player game, the player would initially place the moving droid in the middle of the play area, the stationary droid 70 at a desired location and the border droid 80 at the boundaries of the play area and scatter the tag bases 160 at various locations around the play area. The player would then turn on the mobile droid vehicle 60 and maneuver the toy vehicle 10 in a direction so that it could shoot and hit the mobile droid vehicle 60 while avoiding being hit by the mobile droid vehicle 60, the stationary droid 70 and/or the border droid 80. The toy vehicle 10 may be given a predetermined amount of time to seek out and destroy the mobile droid vehicle 60 before the toy vehicle 10 is disabled and defeated. The predetermined time can be set, for example, for a three minute, five minute or ten minute play time. When the moving droid has received sufficient damage, it can be preprogrammed to indicate it is defeated. For example, it may performs a 360° spin and then shuts down with a loud shut down sound. The toy vehicle 10 can drive around while attempting to attack the mobile droid vehicle 60 and avoid the other droids 70, 80 to run over the tag bases 160 to acquire the use of new weapons and/or other features to help the toy vehicle defeat the mobile droid vehicle.

Game Play—Multiple Players

Figure 10:
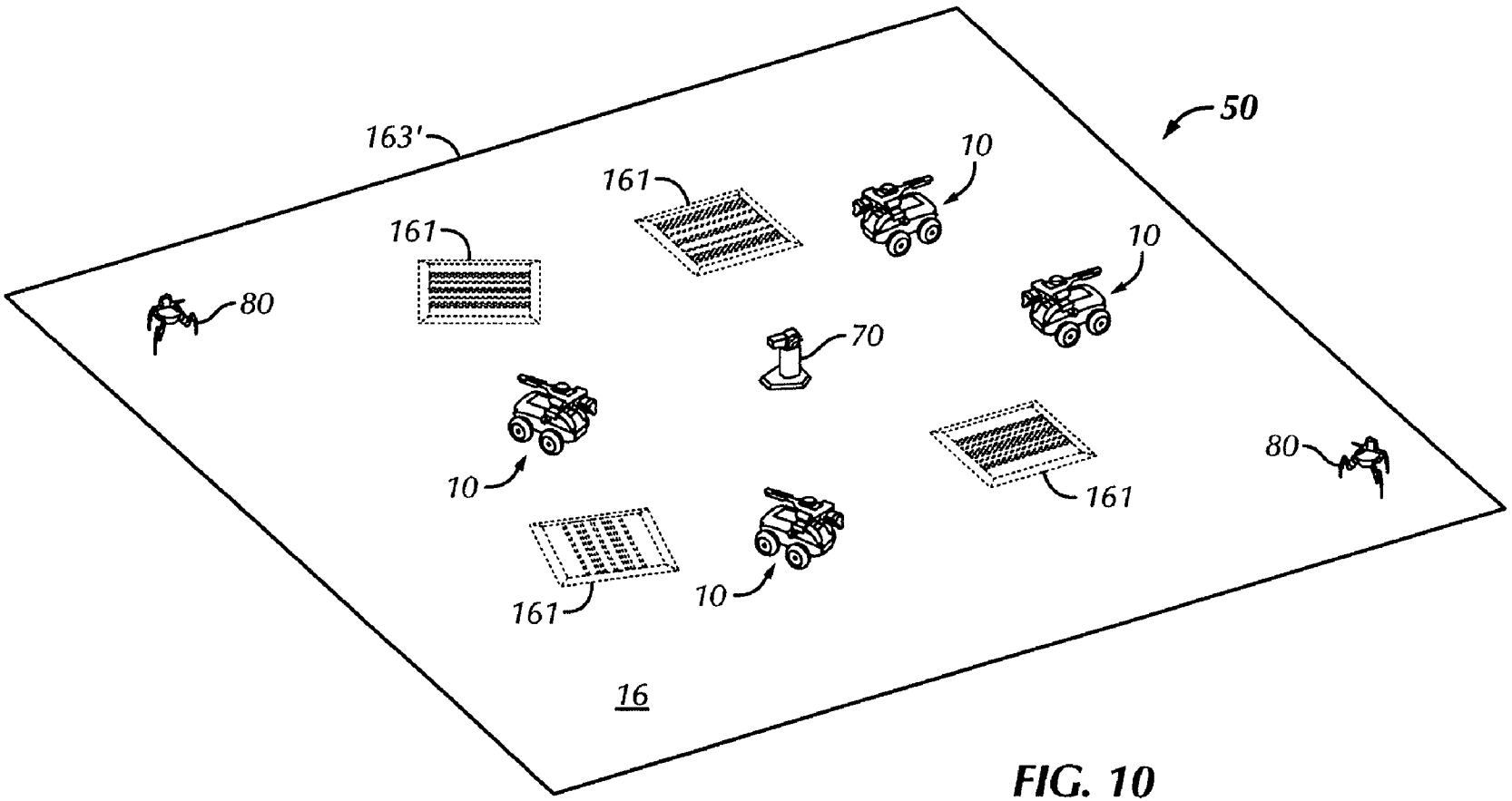
FIG. 10 is a top perspective view of the game system according to an alternative embodiment of the present invention.

In a game in which multiple toy vehicles (e.g. up to four) play against each other, each of the toy vehicles is initially placed within the play area of the toy vehicle system 50 (see FIG. 10). Players or users control individual toy vehicles and compete against each other by attempting to kill one another utilizing the on-board simulated weapons.

Each of the toy vehicles 10 (and its associated simulated driver) may incorporate a separate appearance and styling and its own simulated "personality". For example, each vehicle may have its own name (for example "Punisher", "Technoid", "Stalker", "Scavenger"), its own preferred or default weapon (laser cannon, splatter gun, Gatling gun, rail gun) its own driving and/or firing sounds and other associated characteristics. Overall, the features of all of the toy vehicles should balance out to be relatively equal. For example, one toy vehicle may have a slightly more powerful weapons but with less speed or weaker armor, whereas another vehicle may be slightly faster but with a weaker weapon or weaker armor. Other features will be incorporated into the toy vehicles. For example, after firing a light weapon a predetermined number of times a "reload" period may be imposed during which a reloading sound will be heard and no firing is permitted. Heavy weapons can only be fired a small number of times unless "revived" be passing over a special tag base.

Players simultaneously try to avoid the fire from other vehicles and, possibly from an autonomous moving droid 60 in the field of play. Once defeated, a toy vehicle 10 is immobilized and credit for the kill can be claimed by another active toy vehicle. As vehicles accumulate kills or minutes of play experience, weaponry and/or mobility for the toy vehicle becomes more potent or robust. When a toy vehicle is killed by another toy vehicle, the dead vehicle will broadcast a "killed" signal through its front emission source weapon 310. When another vehicle (the killing vehicle or some other vehicle) detects the "killed" signal, by being in the dead vehicle's line of fire, it can respond with a "claim kill" request. The dead vehicle can "grant" the kill to the requesting vehicle. If the claiming vehicle does not receive the grant signal, then it is lost. A toy vehicle is not able to accept a granted kill signal if it has not recently requested a claim. The firmware of the claiming vehicle provides for this by allowing claims to be accepted for only a limited period of time following a claim request. As the game begins, each user attempts to destroy the other users' toy vehicle utilizing movement techniques and one or more simulated weapons. As the game proceeds, each player attempts to drive his vehicle over or near the tag bases in order to receive the advantages afforded by the tag bases. The tag bases may provide short time advantages such as heavy, medium or light armor, invisibility, an extra missile launcher, etc. Each player receives points based upon passing over or near tag bases, firing a simulated weapon resulting in a hit of another toy vehicle and achieving other goals. The multiplayer game can be played with teams. In addition, one or more of the droids can be used as a common adversary or to add interest in a multiple player game. Alternatively, all of the toy vehicles can play together as a team against one or more droids.

For example, although wireless radio control is preferred, other known forms of wireless control such as optical control might be used. The control signals might be passed over a band width spaced from the bandwidth used by the vehicle "weapons". In such vehicles, control signals would be transmitted by an emitter and received by an appropriate optical sensor. It will be appreciated by those skilled in the art that changes could be made to the embodiments described above without departing from the broad inventive concept thereof. *It is understood, therefore, that this invention is not limited to the particular embodiments disclosed, but it is intended to cover modifications within the spirit and scope of the present invention as defined by the appended claims.

We claim:

1. In a wireless controlled toy vehicle system having a plurality of at least two independently remotely controllable toy vehicles, each of the toy vehicles being independently remotely controlled by a separate, respective, associated manual wireless controller of a plurality of manual wireless controllers of the system, each of the plurality of toy vehicles having actuators for controlling the operation of the plurality of vehicles in accordance with control signals received from the associated, respective manual wireless controller of the plurality of manual wireless controllers, an improvement comprising:

a first manually actuable wireless controller of the plurality being respectively associated with a first of the plurality of toy vehicles and generating a stream of first control signal packets in response to user manual inputs to the first controller, the stream of first control signal packets being transmitted to the plurality of toy vehicles during a first transmission window and coded to control only the first of the plurality of toy vehicles; and a second manually actuable wireless controller being respectively associated with a second of the plurality of toy vehicles and generating a stream of second control signal packets in response to user manual inputs to the second controller, the stream of second control signal packets being transmitted to the plurality of toy vehicles during a second transmission window and coded to control only the second of the plurality of toy vehicles, wherein the first and second transmission windows are time synchronized such that the streams of first and second control signal packets avoid time overlap of each other when transmitted to the plurality of toy vehicles while user inputs are being simultaneously manually entered into at least the first and second manually actuable wireless controllers.

2. The toy vehicle system of claim 1 wherein the first and second transmission windows have a single, common transmission window length (TL).

3. The toy vehicle system of claim 1 wherein each of the plurality of manually actuable wireless controllers of the system include at least one synchronization port such that at least the first and second transmission windows are synchronized when the synchronization ports on the first and second wireless controllers are connected prior to transmission of the streams of first and second control signal packets.

4. The toy vehicle system of claim 1 wherein each control signal packet includes a vehicle identification tag (ID0, ID1) which associates each control signal packet with the associated one of the plurality of toy vehicles.

5. The toy vehicle system of claim 1 wherein the control signal packets include firing data for the associated one of the plurality of toy vehicles.

6. The toy vehicle system of claim 1 wherein the control signal packets include driving data for the associated one of the plurality of toy vehicles.

7. The toy vehicle system of claim 1 wherein the actuators on each of the plurality of two toy vehicles are configured to actuate the toy vehicle upon reception of at least two sequential identical control signal packets from the respective, associated manually actuable wireless controller.

8. The toy vehicle system of claim 1 further comprising a predetermined period of dead time between the first and second transmission windows.

9. The toy vehicle system of claim 1 including at least four of the independently radio controllable toy vehicles and four of the separate manually actuable wireless controllers and wherein at least third and fourth transmission windows are synchronized with one another and with the first and second transmission windows such that streams of first, second, third and fourth control signal packets avoid overlap with each other when transmitted to the toy vehicles while user manual inputs are being simultaneously manually entered into the at least four manually actuable wireless controllers.

10. The toy vehicle system of claim 1 wherein at least the streams of first and second control signal packets are transmitted on the same carrier wireless frequency.

11. A method for controlling a plurality of at least two toy vehicles in a wireless controlled toy vehicle system, each of the toy vehicles of the plurality being remotely controlled by separate respective associated hand-held, manually actuable, wireless controllers, the at least two toy vehicles having actuators for controlling the operation of the at least two toy vehicles in accordance with control signals received from the respective associated manually actuable wireless controllers, the method comprising:

defining a series of sequential, repeated first and second transmission windows, each transmission window having a single, common transmission window length (TL);

time synchronizing the first and second transmission windows such that the first and second windows do not overlap each other;

generating a stream of first control signal packets;

generating a stream of second control signal packets;

transmitting the stream of first control signal packets to the plurality of toy vehicles during the first transmission window to control only a first of the plurality of toy vehicles; and transmitting the stream of second control signal packets to the plurality of toy vehicles during the second transmission window to control only a second of the plurality of toy vehicles.

12. The method of claim 11 wherein the step of synchronizing includes connecting together at least two of the plurality of manually actuable wireless controllers associated with the first and second toy vehicles prior to transmission of the streams of first and second control signal packets to synchronize the at least two manually actuable wireless controllers.

13. The method of claim 12 wherein the step of synchronizing further includes designating one of the at least two manually actuable wireless controllers as a master controller and designating each other manually actuable wireless controller of the plurality connected to the master controller for synchronization as a slave controller.

14. The method of claim 12 wherein the step of synchronizing comprises the step of connecting together the at least two manually actuable wireless controllers at synchronization ports located on each wireless controller of the plurality.

15. The method of claim 11 further comprising the step of actuating one of the at least two toy vehicles only when at least two sequential identical control signal packets are received by the one of the at least two toy vehicles.

16. The method of claim 11 wherein the first control signal packets are transmitted by a first manually actuable wireless controller of the plurality respectively associated with the first toy vehicle and the second control signal packets are transmitted by a second manually actuable wireless controller of the plurality respectively associated with the second toy vehicle.

17. The method of claim 11 wherein each of the control signal packets include firing information for a respective associated one of the at least two toy vehicles.

18. The method of claim 11 wherein each of the control signal packets include driving commands for a respective associated one of the at least two toy vehicles.

19. The method of claim 11 further comprising the step of inserting predetermined periods of dead time in between the first and second transmission windows.

20. The method of claim 11 further comprising the steps of:

defining at least third and fourth transmission windows, each transmission window having a single, common transmission window length (TL) in the series of sequential, repeated transmission windows;

synchronizing the third and fourth with the first and second transmission windows and one another such that the first, second, third and fourth windows avoid overlap of each other;

generating a stream of third control signal packets;

generating a stream of fourth control signal packets;

transmitting the stream of third control signal packets to the plurality of toy vehicles during the third transmission window of the series to control only a third one of the plurality of toy vehicles; and transmitting the stream of fourth control signal packets to the plurality of toy vehicles during the fourth transmission window to control only a fourth one of the plurality of toy vehicles.

21. An interactive toy vehicle game system comprising:

at least one wireless controlled toy vehicle having a mobile platform configured to move over a playing surface, an on-board vehicle controller configured to control the at least one toy vehicle based on manual input from a player, at least one vehicle weapon mounted to the mobile platform and configured to fire on an enemy vehicle and at least one damage sensor mounted to the at least one toy vehicle and configured to detect hits on the at least one toy vehicle; and at least one mobile droid vehicle having a mobile droid platform configured to move over the playing surface, the at least one mobile droid vehicle having an enemy weapon mounted to the mobile droid platform and an on-board mobile droid controller configured to seek the at least one toy vehicle and fire the enemy weapon at the at least one toy vehicle;

wherein the vehicle controller is further configured to disable the at least one toy vehicle when the vehicle controller detects collectively from each damage sensor of the vehicle a predetermined number of hits from the enemy weapon.

22. The toy vehicle game of claim 21 wherein the droid controller is configured to move the at least one mobile droid vehicle over the playing surface in a predefined pattern.

23. The toy vehicle game of claim 21 wherein the droid controller is configured to fire the enemy weapon according to a predetermined firing sequence.

24. The toy vehicle game of claim 21, the mobile droid vehicle comprising a droid damage sensor mounted thereto and coupled to the droid controller, the droid controller being configured to detect hits on the mobile droid vehicle from the at least one vehicle weapon.

25. The toy vehicle game of claim 24 wherein the droid controller is configured to disable the mobile droid when the droid damage sensor detects a predetermined number of hits from the at least one vehicle weapon.

26. The toy vehicle game of claim 21 further comprising at least one border droid having at least two border droid weapons configured to fire in two different directions from the border droid.

27. The toy vehicle game of claim 26 wherein the two directions of fire of the border droid are in opposite directions or at right angles.

28. The toy vehicle game of claim 21 further comprising at least one stationary droid having a rotating turret, the turret including a weapon configured to fire at the at least one toy vehicle.

29. The toy vehicle game of claim 28 wherein the turret is configured to move along a predefined path.

30. The toy vehicle game of claim 29 wherein the vehicle controller is configured to fire the at least one vehicle weapon at another at least one toy vehicle.

* * * * *